US006260602B1

(12) United States Patent
Wagstaff

(10) Patent No.: US 6,260,602 B1
(45) Date of Patent: Jul. 17, 2001

(54) CASTING OF MOLTEN METAL IN AN OPEN ENDED MOLD CAVITY

(75) Inventor: Robert Bruce Wagstaff, Veradale, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 09/572,644

(22) Filed: May 17, 2000

Related U.S. Application Data

(62) Division of application No. 08/954,784, filed on Oct. 21, 1997, now Pat. No. 6,158,498.

(51) Int. Cl.[7] ..... B22D 11/08

(52) U.S. Cl. ..... 164/425; 164/444; 164/268; 164/342

(58) Field of Search ..... 164/425, 444, 164/268, 342, 483, 486, 487, 472, 137, 454

(56) References Cited

U.S. PATENT DOCUMENTS

| | | | |
|---|---|---|---|
| 2,983,972 | 5/1961 | Moritz | 164/420 |
| 3,076,241 | 2/1963 | Simonson et al. | 164/472 |
| 3,212,142 | 10/1965 | Moritz | 164/454 |
| 3,416,222 | 12/1968 | Pearson | 29/527.7 |
| 3,430,680 | 3/1969 | Leghorn | 164/81 |
| 3,445,922 | 5/1969 | Leghorn | 29/527.6 |
| 3,710,436 | 1/1973 | Schoffman | 29/527.6 |
| 4,134,441 | 1/1979 | Ohmori | 164/491 |
| 4,207,941 | 6/1980 | Shrum | 164/484 |
| 4,407,056 | 10/1983 | Watanabe | 29/527.7 |

(List continued on next page.)

FOREIGN PATENT DOCUMENTS

| | | |
|---|---|---|
| 0694355 | 1/1996 | (EP) . |
| 715915 A1 | 6/1996 | (EP) . |
| 59-206133 | 11/1984 | (JP) . |
| 2179336 | 7/1990 | (JP) . |
| 3-23028 | 1/1991 | (JP) . |
| 6073482 | 3/1994 | (JP) . |
| 6-328197 | 11/1994 | (JP) . |

OTHER PUBLICATIONS

Sekiguchi "Forging of Aluminum Alloys" *Light Metals* vol. 44, No. 12 (1994) 741–758.

Cygler et al "Near Net Shape Casting and Associated Mill Developments" Jan. 1995 *Iron and Steel Engineer* 32–38.

Honmura et al "Current Status and Prospect of Aluminum Forging" *Altopia* (1989) 11/9–16.

Korchunov et al "Production of Large Shaped Aluminum Alloy Items in a Semi–continuous Operation Plant" *Bulletin of the Russian academy of Sciences* vol. 58, No. 9, P 1564–1571 (1994).

Peller "Production of Shaped Items from Aluminum and Magnesium Alloys by the Stepanov Method as Compared with Alternative Techniques" *Bulletin of the Russian Academy of Sciences* vol. 58, No. 9, pp. 1559–1563 (1994).

*Primary Examiner*—Kuang Y. Lin
*Assistant Examiner*—I.-H. Lin
(74) *Attorney, Agent, or Firm*—Christopher Duffy

(57) ABSTRACT

When the starter block commences reciprocating along the axis of an open ended mold cavity, with a body of start up material in tandem with it, successive layers of molten metal are relatively superimposed on the body of start up material, and layers thereof are confined to a first cross sectional area of the cavity but permitted to distend relatively peripherally outwardly from the circumferential outline of the first cross sectional area at relatively peripherally outwardly inclined angles to the axis while thermal contraction forces are generated in the respective layers and the magnitude of the forces is controlled so that the thermal contraction forces counterbalance the splaying forces in the respective layers and confer a free-formed circumferential outline on the resulting body of metal as it becomes form-sustaining.

46 Claims, 19 Drawing Sheets

U.S. PATENT DOCUMENTS

| | | | | |
|---|---|---|---|---|
| 4,515,204 | | 5/1985 | Ohno | 164/483 |
| 4,598,763 | * | 7/1986 | Wagstaff et al. | 164/472 |
| 4,619,308 | | 10/1986 | Kawawa | 164/416 |
| 4,709,744 | * | 12/1987 | Bryson et al. | 164/472 |
| 4,714,498 | | 12/1987 | Khare | 148/11.5 N |
| 4,823,577 | | 4/1989 | Kawashima | 72/24 |
| 4,918,803 | | 4/1990 | DiGiusto | 29/33 C |
| 4,976,024 | | 12/1990 | Kimura | 29/527.6 |
| 4,998,338 | | 3/1991 | Seidel | 29/527.6 |
| 5,103,892 | | 4/1992 | Hugens | 164/431 |
| 5,318,098 | * | 6/1994 | Wagstaff et al. | 164/444 |
| 5,335,716 | * | 8/1994 | Takesne et al. | 164/483 |
| 5,386,869 | | 2/1995 | Wilde | 164/491 |
| 5,409,053 | | 4/1995 | Kawa | 164/418 |
| 5,472,041 | | 12/1995 | Cryderman | 164/476 |
| 5,582,230 | * | 12/1996 | Wagstaff et al. | 164/483 |
| 5,632,325 | | 5/1997 | Fischer | 164/477 |

* cited by examiner

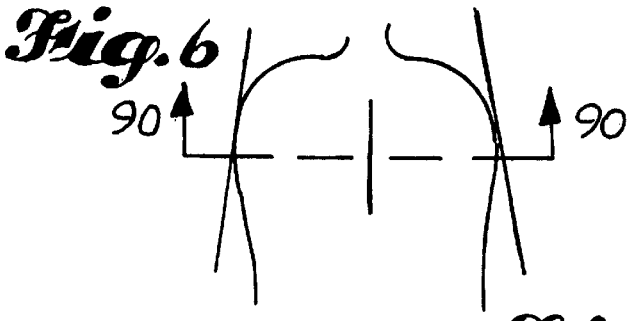
Fig. 6
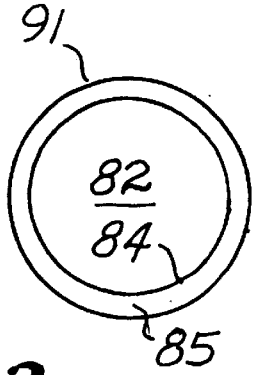
Fig. 1
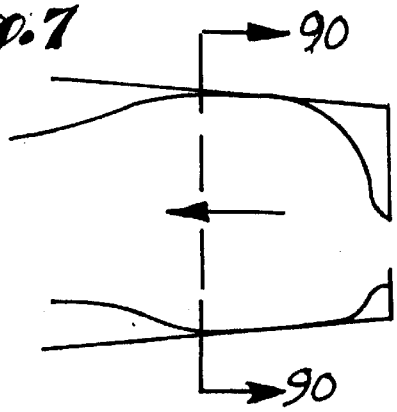
Fig. 7
Fig. 2
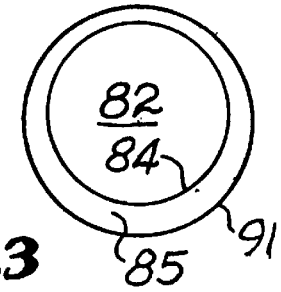
Fig. 3
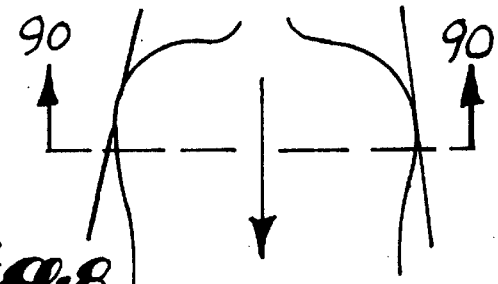
Fig. 8
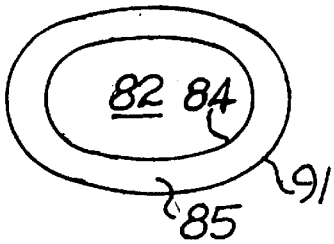
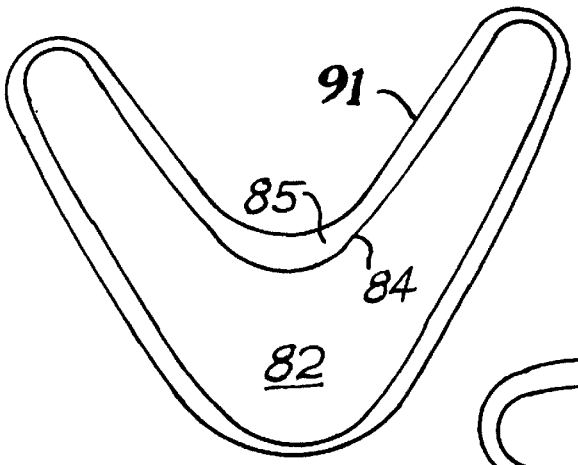
Fig. 4
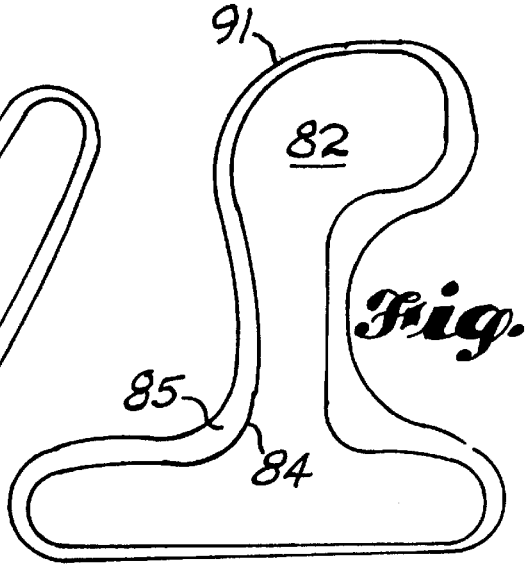
Fig. 5

CASTING OF MOLTEN METAL IN AN OPEN ENDED MOLD CAVITY

RELATED APPLICATION

This Application is a Division of application Ser. no. 08/954,784, filed on Oct. 21, 1997 under the title CASTING OF MOLTEN METAL IN AN OPEN ENDED MOLD CAVITY, and now U.S. Pat. No. 6,158,498.

TECHNICAL FIELD

This invention relates to the casting of molten metal in an open ended mold cavity, and in particular, to the peripheral confinement of the molten metal which is forced through the cavity during the casting of it into a form-sustaining end product.

BACKGROUND ART

Present day open ended mold cavities have an entry end portion, a discharge end opening, an axis extending between the discharge end opening and the entry end portion of the cavity, and a wall circumposed about the axis of the cavity between the discharge end opening and the entry end portion thereof to confine the molten metal to the cavity during the passage of the metal through the cavity. When a casting operation is to be carried out, a start block is telescopically engaged in the discharge end opening of the cavity. The block is reciprocable along the axis of the cavity, but initially, it is stationed in the opening while a body of molten startup material is interposed in the cavity between the starter block and a first cross sectional plane of the cavity extending relatively transverse the axis thereof. Then, while the starter block is reciprocated relatively outwardly from the cavity along the axis thereof, and the body of startup material is reciprocated in tandem with the starter block through a series of second cross sectional planes of the cavity extending relatively transverse the axis thereof, successive layers of molten metal having lesser cross sectional areas in planes transverse the axis of the cavity than the cross sectional area defined by the wall of the cavity in the first cross sectional plane thereof, are relatively superimposed on the body of startup material adjacent the first cross sectional plane of the cavity. Because of their lesser cross sectional areas, each of the respective layers has inherent splaying forces therein acting to distend the layer relatively peripherally outwardly from the axis of the cavity adjacent the first cross sectional plane thereof It so distends until the layer is intercepted by the wall of the cavity where, due to the fact that the wall is at right angles to the first cross sectional plane of the cavity, the layer is forced to undergo a sharp right angular turn into the series of second cross sectional planes of the cavity, and to undertake a course through them parallel to that of the wall, i.e., perpendicular to the first cross sectional plane. Meanwhile, on contact with the wall, the layer begins to experience thermal contraction forces, and in time, the thermal contraction forces effectively counterbalance the splaying forces and a condition of "solidus" occurs in one of the second cross sectional planes. Thereafter, as the layer becomes an integral part of what is now a newly formed body of metal, the layer proceeds to shrink away from the wall as it completes its passage through the cavity in the body of metal.

Between the first cross sectional plane of the cavity, and the one second cross sectional plane thereof wherein "solidus" occurs, the layer is forced into close contact with the wall of the cavity, and this contact produces friction which operates counter to the movement of the layer and tends to tear at the outer peripheral surface of it, even to the extent of tending to separate it from the layers adjoining it. Therefore, practitioners in the art have long attempted to find ways either to lubricate the interface between the respective layers and the wall, or to separate one from the other at the interface therebetween. They have also sought ways to shorten the width of the band of contact between the respective layers and the wall. Their efforts have produced various strategies including that disclosed in U.S. Pat. No. 4,598,763 and that disclosed in U.S. Pat. No. 5,582,230. In U.S. Pat. No. 4,598,763, an oil encompassed sleeve of pressurized gas is interposed between the wall and the layers to separate one from the other. In U.S. Pat. No. 5,582,230, a liquid coolant spray is developed around the body of metal and then driven onto the body in such a way as to shorten the width of the band of contact. Their efforts have also produced a broad variety of lubricants; and while their combined efforts have met with some success in lubricating and/or separating the layers from the wall and vice versa, they have also produced a new and different kind of problem relating to the lubricants themselves. There is a high degree of heat exchanged across the interface between the layers and the wall, and the intense heat may decompose a lubricant. The products of its decomposition often react with the ambient air in the interface to form particles of metal oxide and the like which become "rippers" at the interface that in turn produce so-called "zippers" along the axial dimension of any product produced in this way. The intense heat may even cause a lubricant to combust, creating in turn a hot metal to cold surface condition wherein the frictional forces are then largely unrelieved by any lubricant whatsoever.

DISCLOSURE OF THE INVENTION

The present invention departs entirely from the various prior art strategies for lubricating and separating the layers from the wall at the interface therebetween, and from the various prior art strategies for shortening the band of contact between the layers and the wall. Instead, the invention eliminates the "confrontation" which occurred between the layers and wall, and which gave rise to the problems requiring these prior art strategies. And in their place, the invention substitutes a whole new strategy for controlling the relatively peripherally outward distention of the respective layers in the cavity during the passage of the molten metal therethrough.

According to the invention, the relatively peripherally outward distention of respective layers of molten metal is confined to a first cross sectional area of the cavity in the first cross sectional plane thereof, while the respective layers are permitted to distend relatively peripherally outwardly from the circumferential outline of the first cross sectional area at relatively peripherally outwardly inclined angles to the axis of the cavity in which the layers assume progressively peripherally outwardly greater second cross sectional areas of the cavity in the aforementioned second cross sectional planes thereof. Moreover, thermal contraction forces are generated in the respective layers as the layers assume the second cross sectional areas of the cavity and the magnitude of the thermal contraction forces is controlled in the respective layers so that the thermal contraction forces counterbalance the splaying forces in the respective layers at one of the second cross sectional planes of the cavity and thereby confer a free-formed circumferential outline on the body of metal as the body of metal becomes form-sustaining. In this way, the layers are no longer confronted with a wall or some other means of peripheral confinement, but like a child being taught to walk while a parent extends an outstretched arm on which the child can lean while the parent gradually backs away from the child, so too the layers are given a kind of passive support at the outer peripheries thereof, such as by the use of baffling means, while they, the layers, are "encouraged" to aggregate on their own, and to form a coherent skin of their own choosing, rather than accepting one imposed on them by a surrounding wall or the like. Also, as fast as the thermal contraction forces can take over from the baffling means, the baffling means are withdrawn so that contact between the layers and any restraining medium is virtually eliminated. This means that it is no longer necessary to lubricate or buffer an interface between the layers and a peripheral confinement means, but it does not preclude continuing to use a lubricating or buffering medium about the layers. In fact, in many of the presently preferred embodiments of the invention, a sleeve of pressurized gas is circumposed about the layers of molten metal in the second cross sectional planes of the cavity. Also an annulus of oil is commonly circumposed about the layers of molten metal in the second cross sectional planes of the cavity; and in certain embodiments, an oil encompassed sleeve of pressurized gas is circumposed about the layers, as in U.S. Pat. No. 4,598,763. The oil encompassed sleeve of pressurized gas is commonly formed by discharging pressurized gas and oil into the cavity at second cross sectional planes thereof, and preferably, simultaneously.

The thermal contraction forces are commonly generated by extracting heat from the respective layers in the direction relatively peripherally outwardly from the axis of the cavity in second cross sectional planes thereof For example, in many of the presently preferred embodiments of the invention, the heat is extracted by operatively arranging a heat conductive medium about the circumferential outlines of the second cross sectional areas of the cavity and extracting heat from the layers through the medium. In certain presently preferred embodiments of the invention, heat conductive baffling means are arranged about the circumferential outlines of the second cross sectional areas of the cavity, and heat is extracted from the layers through the baffling means, for example, by circumposing an annular chamber about the baffling means and circulating liquid coolant through the chamber.

Heat may also be extracted from the layers through the body of metal itself, such as by discharging liquid coolant onto the body of metal at the opposite side of the one second cross sectional plane of the cavity from the first cross sectional plane thereof. Preferably, the liquid coolant is discharged onto the body of metal between planes extending transverse the axis of the cavity and coinciding with the bottom and rim of the trough-shaped model formed by the successively convergent isotherms of the body of metal.

The liquid coolant may be discharged onto the body of metal from an annulus circumposed about the axis of the cavity between the one second cross sectional plane of the cavity and the discharge end opening thereof, or the liquid coolant may discharged onto the body of metal from an annulus circumposed about the axis of the cavity on the other side of the discharge end opening of the cavity from the one second cross sectional plane thereof. Preferably, the liquid coolant is discharged from a series of holes arranged in an annulus about the axis of the cavity and divided into rows of holes in which the respective holes thereof are staggered in relation to one another from row to row, as in U.S. Pat. No. 5,582,230.

In certain of the presently preferred embodiments of the invention, the annulus is circumpositioned on the mold at the inner periphery of the cavity, and in other embodiments the annulus is circumpositioned on the mold relatively outside of the cavity adjacent the discharge end opening thereof In some presently preferred embodiments of the invention, a reentrant baffling effect is generated in cross sectional planes of the cavity extending transverse the axis thereof between the one second cross sectional plane of the cavity and the discharge end opening thereof, to induce "rebleed" to reenter the body of metal.

At times, sufficient layers of the molten metal are relatively superimposed on the body of start up material to elongate the body of metal axially of the cavity. When this is done, the elongated body of metal may be subdivided into successive longitudinal sections thereof, and in addition, the respective longitudinal sections may be post treated, such as by post forging them.

In a group of embodiments illustrated in part in the accompanying drawings, baffling means are arranged about the axis of the cavity to confine the relatively peripherally outward distention of the respective layers to the respective first and second cross sectional areas thereof. The baffling means may be electromagnetic means, or sets of air knives, or any other such baffling means. However, as seen in the drawings, in some embodiments, the baffling means define a series of annular surfaces that are circumposed about the axis of the cavity to confine the relatively peripheral outward distention of the layers to the first cross sectional area of the cavity, while permitting respective layers to assume progressively peripherally outwardly greater second cross sectional areas of the cavity in second cross sectional planes thereof. In certain embodiments, the individual annular surfaces are arranged in axial succession to one another, but staggered relatively peripherally outwardly from one another in the respective first and second cross sectional planes of the cavity, and oriented along relatively peripherally outwardly inclined angles to the axis of the cavity so as to permit the respective layers to assume progressively peripherally outwardly greater second cross sectional areas in second cross sectional planes of the cavity. In one special set of embodiments, the annular surfaces are interconnected with one another axially of the cavity to form an annular skirt. And as illustrated, the skirt may be formed on the wall or other peripheral confinement means of the cavity at the inner periphery thereof, such as between the first cross sectional plane of the cavity and the discharge end opening thereof.

Where a portion of the wall is formed with a graphite casting ring, the skirt is usually formed on the ring about the inner periphery thereof.

The skirt may have a rectilinear flare about the inner periphery thereof, or it may have a curvilinear flare about the inner periphery thereof.

In addition to serving as a way of conferring a free formed circumferential outline on the body of metal at the one second cross sectional plane of the cavity, the invention may also be employed as a way of generating any shape desired in the circumferential outline, and any size desired in the cross sectional area defined by the outline. The desired shape and/or size may be generated, moreover, while the axis of the cavity is oriented to a vertical line in any way desired. For example, the axis of the cavity may be oriented along a vertical line, the first cross sectional area may be confined to a circular circumferential outline, and the invention may be employed to confer a noncircular circumferential outline on the body of metal at the one second cross sectional plane of the cavity. Or the axis of the cavity may be oriented along an angle to a vertical line, the first cross sectional area may be confined to a circular circumferential outline, and the invention may be employed to confer a circular circumferential outline on the body of metal at the one second cross sectional plane of the cavity. Or the axis of the cavity may be oriented along one of a vertical line and an angle to a vertical line, the first cross sectional area may be confined to a non-circular circumferential outline, and a non-circular circumferential outline may be conferred on the body of metal at the one second cross sectional plane of the cavity. Meanwhile, when desired, the first cross sectional area of the cavity may be confined to a first size in a first casting operation, and then confined to a second and different size in a second casting operation in the same cavity, so as to vary the size of the cross sectional area conferred on the body of metal at the one second cross sectional plane of the cavity from the first to the second casting operation.

In many of the presently preferred embodiments of the invention, the axis of the cavity is oriented to a vertical line, the circumferential outline of the first cross sectional area is confined, and at least one control parameter in the group consisting of the relative thermal contraction forces generated in the respective angularly successive part annular portions of the layers arrayed about the circumferences thereof in the second cross sectional planes of the cavity and the relative angles at which the respective part annular portions of the layers are permitted to distend from the circumferential outline of the first cross sectional area into the series of second cross sectional planes to assume the second cross sectional areas thereof, is varied to generate a desired shape in the circumferential outline conferred on the body of metal at the one second cross sectional plane of the cavity. In generating the desired shape, moreover, the one control parameter may be varied to neutralize variances between the differentials existing between the respective splaying and thermal contraction forces in angularly successive part annular portions of the layers that are mutually opposed to one another across the cavity in third cross sectional planes of the cavity extending parallel to the axis thereof. Or the one control parameter may be varied to create variances between the aforedescribed differentials in the aforedescribed third cross sectional planes of the cavity.

Throughout it all, the thermal contraction forces generated in those angularly successive part annular portions of the layers arrayed about the circumferences thereof and disposed on mutually opposing sides of the cavity, are equalized to balance the thermal stresses arising between the respective mutually opposing part annular portions of the layers at the one second cross sectional plane of the cavity. In those embodiments, for example, wherein the thermal contraction forces are generated by extracting heat from the angularly successive part annular portions of the layers in second cross sectional planes of the cavity, the thermal contraction forces generated in part annular portions of the layers disposed on mutually opposing sides of the cavity, are balanced by varying the rate at which heat is extracted from the respective mutually opposing part annular portions of the layers. And where the heat is extracted by discharging liquid coolant onto the body of metal at the opposite side of the one second cross sectional plane of the cavity from the first cross sectional plane thereof, the rate of heat extraction from the mutually opposing part annular portions of the layers is varied by varying the volume of coolant discharged onto the respective angularly successive part annular portions of the body of metal arrayed about the circumference thereof.

The size to which the first cross sectional area is confined between the respective first and second casting operations mentioned above, may be changed by changing the circumferential extent of the circumferential outline to which the first cross sectional area is confined in the first cross sectional plane of the cavity.

When baffling means are arranged about the axis of the cavity to confine the distention of the layers to the respective first and second cross sectional areas of the cavity, the circumferential extent of the circumferential outline to which the first cross sectional area of the cavity is confined, may be changed by shifting the baffling means and the first and second cross sectional planes of the cavity in relation to one another. Moreover, the baffling means and the planes may be shifted in relation to one another by varying the volume of molten metal that is superimposed on the body of startup material to shift the planes in relation to the baffling means; or by rotating the baffling means about an axis of rotation transverse the axis of the cavity to shift the baffling means in relation to the planes.

The circumferential extent of the circumferential outline to which the first cross sectional area is confined, may also be changed by dividing the baffling means into pairs thereof, arranging the respective pairs of baffling means about the axis of the cavity on pairs of mutually opposing sides thereof, and shifting the respective pairs of baffling means in relation to one another crosswise the axis of the cavity. Moreover, one of the pairs of baffling means may simply be reciprocated in relation to one another crosswise the axis of the cavity to shift the pairs thereof in relation to one another; or another of the pairs of baffling means may also be rotated about axes of rotation transverse the axis of the cavity to shift the pairs of baffling means in relation to one another.

The circumferential extent of the outline may also be changed by dividing the baffling means into a pair thereof, arranging the pair of baffling means about the axis of the cavity in axial succession to one another, and shifting the pair of baffling means in relation to one another axially of the cavity, for example, by inverting the pair of baffling means in relation to one another axially of the cavity.

In some presently preferred embodiments of the invention, the thermal contraction forces are generated in all of the angularly successive part annular portions of the layers arrayed about the circumferences of the layers.

Structurally, the invention comprises a combination of the aforedescribed apparatus defining an open ended mold cavity and means which accompany the apparatus and function for the aforedescribed purposes when molten metal is cast into a form sustaining body of metal in the cavity. The cavity has an entry end portion, a discharge end opening, and an axis extending between the discharge end opening and the entry end portion of the cavity. As aforedescribed, molten metal is cast into a form sustaining body of metal in the cavity by forcing molten metal into the entry end portion of the cavity while a starter block telescopically engaged in the discharge end opening of the cavity, is reciprocated relatively outwardly from the cavity along the axis thereof, a body of startup material interposed between the starter block and a first cross sectional plane of the cavity extending relatively transverse the axis thereof, is reciprocated in tandem with the starter block through a series of second cross sectional planes of the cavity extending relatively transverse the axis thereof, and successive layers of molten metal are relatively superimposed on the body of startup material adjacent the first cross sectional plane of the cavity so as to have inherent splaying forces therein acting to distend the layers relatively peripherally outwardly from the axis of the cavity adjacent the first cross sectional plane thereof. The means accompanying the apparatus include means for confining the relatively peripheral outward distention of the respective layers of the molten metal to a first cross sectional area of the cavity in the first cross sectional plane thereof, while permitting the respective layers to distend relatively peripherally outwardly from the circumferential outline of the first cross sectional area at relatively peripherally outwardly inclined angles to the axis of the cavity in which the layers assume progressively relatively peripherally outwardly greater second cross sectional areas of the cavity in second cross sectional planes thereof. The accompanying means also include means for generating thermal contraction forces in the respective layers as the layers assume the second cross sectional areas, and means for controlling the magnitude of the thermal contraction forces in the respective layers so that the thermal contraction forces counterbalance the splaying forces in the respective layers at one of the second cross sectional planes of the cavity and thereby confer a free-formed circumferential outline on the body of metal as the body of metal becomes form sustaining.

The combination of apparatus and accompanying means may further comprise means for circumposing a sleeve of pressurized gas about the layers of molten metal in the second cross sectional planes of the cavity; and/or means for circumposing an annulus of oil about the layers of molten metal in the second cross sectional planes of the cavity. Moreover, the combination may further comprise lubricating means for circumposing an oil encompassed sleeve of pressurized gas about the layers of molten metal in the second cross sectional planes of the cavity. The lubricating means may also be operable to discharge the pressurized gas and oil into the cavity at the second cross sectional planes thereof.

The means for generating thermal contraction forces may include means for extracting heat from the respective layers in the direction relatively peripherally outwardly from the axis of the cavity in second cross sectional planes thereof. The heat extraction means may in turn include a heat conductive medium operatively arranged about the circumferential outlines of the second cross sectional areas of the cavity, and means for extracting heat from the layers through the medium. For example, heat conductive baffling means may be arranged about the circumferential outlines of the second cross sectional areas of the cavity, and the heat extraction means may include means for extracting heat from the layers through the baffling means. In certain presently preferred embodiments of the invention, the means for extracting heat from the layers through the baffling means include an annular chamber circumposed about the baffling means and means for circulating liquid coolant through the chamber.

The combination with heat extraction means may also include means for extracting heat from the layers through the body of metal. For example, the means for extracting heat from the layers through the body of metal may include means for discharging liquid coolant onto the body of metal at the opposite side of the one second cross sectional plane of the cavity from the first cross sectional plane thereof. Preferably, the liquid coolant discharge means are operable to discharge the liquid coolant onto the body of metal between planes extending transverse the axis of the cavity and coinciding with the bottom and rim of the trough-shaped model formed by the successively convergent isotherms of the body of metal.

Often, the combination with liquid coolant discharge means further comprises means defining an annulus circumposed about the axis of the cavity between the one second cross sectional plane of the cavity and the discharge end opening thereof, and in such a case, the liquid coolant discharge means may be operable to discharge the liquid coolant onto the body of metal from the annulus; and/or the combination further comprises means defining an annulus circumposed about the axis of the cavity on the other side of the discharge end opening of the cavity from the one second cross sectional plane thereof, and the liquid coolant discharge means may be operable to discharge the liquid coolant onto the body of metal from the latter annulus. In many of the presently preferred embodiments of the invention, the combination further comprises means defining a series of holes arranged in an annulus about the axis of the cavity and divided into rows of holes in which the respective holes thereof are staggered in relation to one another from row to row, and the liquid coolant discharge means are operable to discharge the liquid coolant from the series of holes. The annulus may be circumpositioned on the mold at the inner periphery of the cavity or circumpositioned on the mold relatively outside of the cavity adjacent the discharge end opening thereof.

In some presently preferred embodiments of the invention, the combination further comprises means for generating a reentrant baffling effect in cross sectional planes of the cavity extending transverse the axis thereof between the one second cross sectional plane of the cavity and the discharge end opening thereof to induce "rebleed" to reenter the body of metal.

In fact, in certain presently preferred embodiments of the invention, the combination further comprises baffling means arranged about the axis of the cavity to confine the relatively peripheral outward distention of the respective layers to the respective first and second cross sectional areas thereof In one group of embodiments, the baffling means actually define a series of annular surfaces that are circumposed about the axis of the cavity to confine the relatively peripheral outward distention of the layers to the first cross sectional area of the cavity while permitting respective layers to assume progressively peripherally outwardly greater cross sectional areas of the cavity in second cross sectional planes thereof In some of these latter embodiments, moreover, the individual annular surfaces are arranged in axial succession to one another, but staggered relatively peripherally outwardly to one another in the respective first and second cross sectional planes of the cavity, and are oriented along relatively peripherally outwardly inclined angles to the axis of the cavity so as to permit the respective layers to assume progressively peripherally outwardly greater second cross sectional areas in second cross sectional planes of the cavity.

Furthermore, in certain embodiments of the group, the annular surfaces are interconnected with one another axially of the cavity to form an annular skirt, and in some of the latter embodiments, the skirt is formed on the wall of the cavity at the inner periphery thereof between the first cross sectional plane of the cavity and the discharge end opening thereof. For example, in one special group of embodiments, a graphite casting ring forms a portion of the wall and the skirt is formed on the ring about the inner periphery thereof.

When the annular surfaces are interconnected with one another axially of the cavity to form an annular skirt, the skirt may have a rectilinear flare about the inner periphery thereof, or it may have a curvilinear flare about the inner periphery thereof.

As was indicated earlier in describing the inventive process, the invention may also be employed as a way of generating any shape desired in the circumferential outline conferred on the body of metal at the one second cross sectional plane of the cavity, and/or any size desired in the cross sectional area defined by the outline. Moreover, the desired shape and/or size may be generated while the axis of the cavity is oriented to a vertical line in any way desired. Therefore, using the same illustrations, the axis of the cavity may be oriented along a vertical line, the distention confining means may be operable to confine the first cross sectional area to a circular circumferential outline, and the combination of apparatus and means may further comprise means for conferring a non-circular circumferential outline on the body of metal at the one second cross sectional plane of the cavity. Or the axis of the cavity may be oriented along an angle to a vertical line, the distention confining means may be operable to confine the first cross sectional area to a circular circumferential outline, and the combination may further, comprise means for conferring a circular circumferential outline on the body of metal at the one second cross sectional plane of the cavity. Or the axis of the cavity may be oriented along one of a vertical line and an angle to a vertical line, the distention confining means may be operable to confine the first cross sectional area to a non-circular circumferential outline, and the combination may further comprise means for conferring a noncircular circumferential outline on the body of metal at the one second cross sectional plane of the cavity.

In many of the presently preferred embodiments of the invention, the combination further comprises means operable in conjunction with the orientation of the axis of the cavity to a vertical line and the circumferential outline to which the first cross sectional area is confined, to vary at least one control parameter in the group consisting of the relative thermal contraction forces generated in the respective angularly successive part annular portions of the layers arrayed about the circumferences thereof in the second cross sectional planes of the cavity and the relative angles at which the respective part annular portions of the layers are permitted to distend from the circumferential outline of the first cross sectional area into the series of second cross sectional planes to assume the second cross sectional areas thereof, to generate a desired shape in the circumferential outline conferred on the body of metal in the one second cross sectional plane of the cavity. In some embodiments, the means for varying the one control parameter are operable to neutralize variances between the differentials existing between the respective splaying and thermal contraction forces in angularly successive part annular portions of the layers that are mutually opposed to one another across the cavity in third cross sectional planes of the cavity extending parallel io the axis thereof In other embodiments, the means for varying the one control parameter are operable to create variances between the differentials existing between the respective splaying and thermal contraction forces in angularly successive part annular portions of the layers that are mutually opposed to one another across the cavity in third cross sectional planes of the cavity extending parallel to the axis thereof.

Commonly, the combination of apparatus and means further comprises means for equalizing the thermal contraction forces generated in those angularly successive part annular portions of the layers arrayed about the circumferences thereof and disposed on mutually opposing sides of the cavity, to balance the thermal stresses arising between the respective mutually opposing part annular portions of the layers at the one second cross sectional plane of the cavity. For example, where the means for generating thermal contraction forces include means for extracting heat from the angularly successive part annular portions of the layers in second cross sectional planes of the cavity, the means for balancing the thermal stresses generated in part annular portions of the layers disposed on mutually opposing sides of the cavity may include means for varying the rate of heat extraction between the respective mutually opposing part annular portions of the layers. Moreover, where the heat extraction means also include means for discharging liquid coolant onto the body of metal at the opposite side of the one second cross sectional plane of the cavity from the first cross sectional plane thereof, the means for varying the rate of heat extraction from the mutually opposing part annular portions of the layers may include means for varying the volume of liquid coolant discharged onto the respective angularly successive part annular portions of the body of metal.

Continuing further, the combination of apparatus and means may also comprise size variation means for confining the first cross sectional area of the cavity to a first size for a first casting operation and then confining the first cross sectional area of the cavity to a second and different size for a second casting operation in the cavity, so that the size of the cross sectional area conferred on the body of metal at the one second cross sectional plane of the cavity is varied from the first to the second casting operation. For example, in many presently preferred embodiments of the invention, the size variation means include means for changing the circumferential extent of the circumferential outline to which the first cross sectional area is confined in the first cross sectional plane of the cavity. In certain embodiments, for example, wherein the combination of apparatus and means further comprises baffling means arranged about the axis of the cavity and adapted to confine the distention of the layers to the respective first and second cross sectional area of the cavity, the means for changing the circumferential extent of the circumferential outline to which the first cross sectional area of the cavity is confined, may include means for shifting the baffling means and the first and, second cross sectional planes of the cavity in relation to one another. The means for shifting the baffling means and the first and second cross sectional planes of the cavity in relation to one another may in turn include means for varying the volume of molten metal that is superimposed on the body of startup material so as to shift the respective planes in relation to the baffling means. And where the baffling means are rotatably mounted about an axis of rotation transverse the axis of the cavity, the means for shifting the baffling means and the first and second cross sectional planes of the cavity in relation to one another may include means for rotating the baffling means about the axis of rotation thereof.

Where the combination of apparatus and means further comprises baffling means arranged about the axis of the cavity and adapted to confine the distention of the layers to the respective first and second cross sectional areas of the cavity, the baffling means may be divided into pairs thereof arranged about the axis of the cavity on pairs of mutually opposing sides thereof, and the means for changing the circumferential extent of the circumferential outline to which the first cross sectional area is confined in the first cross sectional plane of the cavity, may include means for shifting the respective pairs of baffling means in relation to one another crosswise the axis of the cavity. In certain presently preferred embodiments of the invention, one of the pairs of baffling means is mounted to be reciprocated relatively crosswise the axis of the cavity, and the means for shifting the respective pairs of baffling means in relation to one another include means operable to reciprocate the one pair of baffling means relatively crosswise the axis of the cavity. In embodiments wherein another of the pairs of baffling means is rotatably mounted about axes of rotation transverse the axis of the cavity, the means for shifting the respective pairs of baffling means in relation to one another may also include means operable to rotate the other pair of baffling means about the axes of rotation thereof Where the combination of apparatus and means further comprises baffling means arranged about the axis of the cavity to confine the distention of the layers to the first and second cross sectional areas of the cavity, the baffling means may be divided into a pair thereof arranged about the axis of the cavity in axial succession to one another, and the means for changing the circumferential extent of the circumferential outline to which the first cross sectional area is confined, may include means for shifting the pair of baffling means in relation to one another axially of the cavity. For example, in certain presently preferred embodiments of the invention, the pair of baffling means is adapted to be inverted in relation to one another axially of the cavity.

Often, the means for generating thermal contraction forces are operable to generate the thermal contraction forces in all of the angularly successive part annular portions of the layers arrayed about the circumferences of the layers, as indicated earlier.

BRIEF DESCRIPTION OF THE DRAWINGS

These features will be better understood by reference to the accompanying drawings wherein several presently preferred embodiments of the invention are illustrated in the context of first depositing molten metal in the cavity to serve as the body of startup material, and then either in a continuous or semi-continuous casting operation, superimposing successive layers of molten metal on the body of molten startup material to form an elongated body of metal extending relatively outwardly of the cavity axially thereof.

In the drawings:

FIGS. 1–5 illustrate several cross sectional areas and circumferential outlines that may be conferred on a body of metal at the cross sectional plane in which "solidus" occurs; and in addition, they also show the "first" cross sectional area and the "penumbra" of second cross sectional area that is needed between the circumferential outline of the first cross sectional area and the plane of "solidus" if the process and apparatus of the invention are to be fully successful in conferring the respective areas and outlines on the body of metal;

FIGS. 6–8 are schematic representations of a mold which may be employed in casting each of the examples in FIGS. 1–3; and the Figures also show schematically the plane in which the examples of FIGS. 1–3 are taken;

BEST MODE FOR CARRYING OUT THE INVENTION

Refer initially to FIGS. 1–8, and make a cursory examination of them. Further reference will be made to them later, and to the numerals in them, but for now note the broad variety of shapes that can be cast by the process and apparatus of the invention. As indicated earlier, any shape desired can be cast. Moreover, the shape can be cast horizontally, vertically, or even at an incline other than horizontal. FIGS. 1–5 are merely representative. But they include casting a cylindrical shape in a vertically oriented mold, as in FIGS. 1 and 6, casting a cylindrical shape in a horizontal mold, as in FIGS. 2 and 7, casting an oblong or other symmetrical noncircular shape, as in FIGS. 3 and 8, casting an axisymmetric noncircular shape such as the V-shape seen in FIG. 4, and casting a wholly asymmetrical noncircular shape such as that seen in FIG. 5.

The. ultimate shape before contraction thereof, is that seen at 91 in FIGS. 1–5. Because each body of metal undergoes contraction below or to the left of the plane 90—90 seen in FIGS. 6, 7 and 8, the final shape of it is slightly smaller in cross sectional area and circumferential outline than those seen in FIGS. 1–5. But to make it possible to illustrate the invention meaningfully, FIGS. 1–5 show the areas and outlines taken on by the bodies when the splaying forces in them have been counterbalanced by the thermal contraction forces in them, i.e., when the point of "solidus" has been reached in each. This point occurs in the plane 90—90 of FIG. 18, and therefore, is represented as the plane 90—90 in each of FIGS. 6–8. The remaining numerals and the features to which they allude, will have more meaning when this description has continued further.

Figure 16:
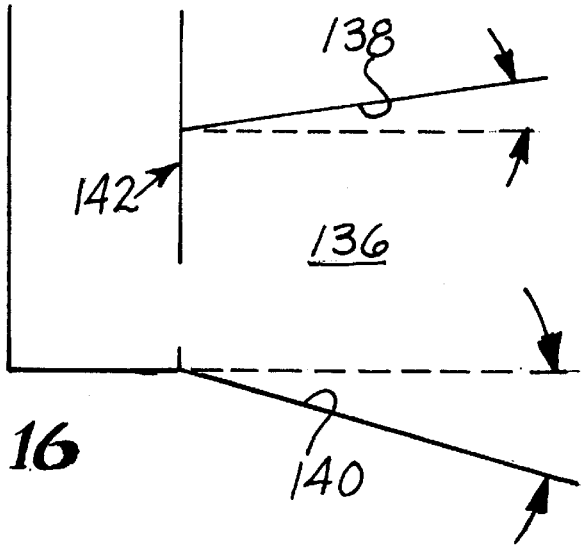
FIG. 16 is a further schematic representation in support of FIGS. 2 and 7.
Figure 17:
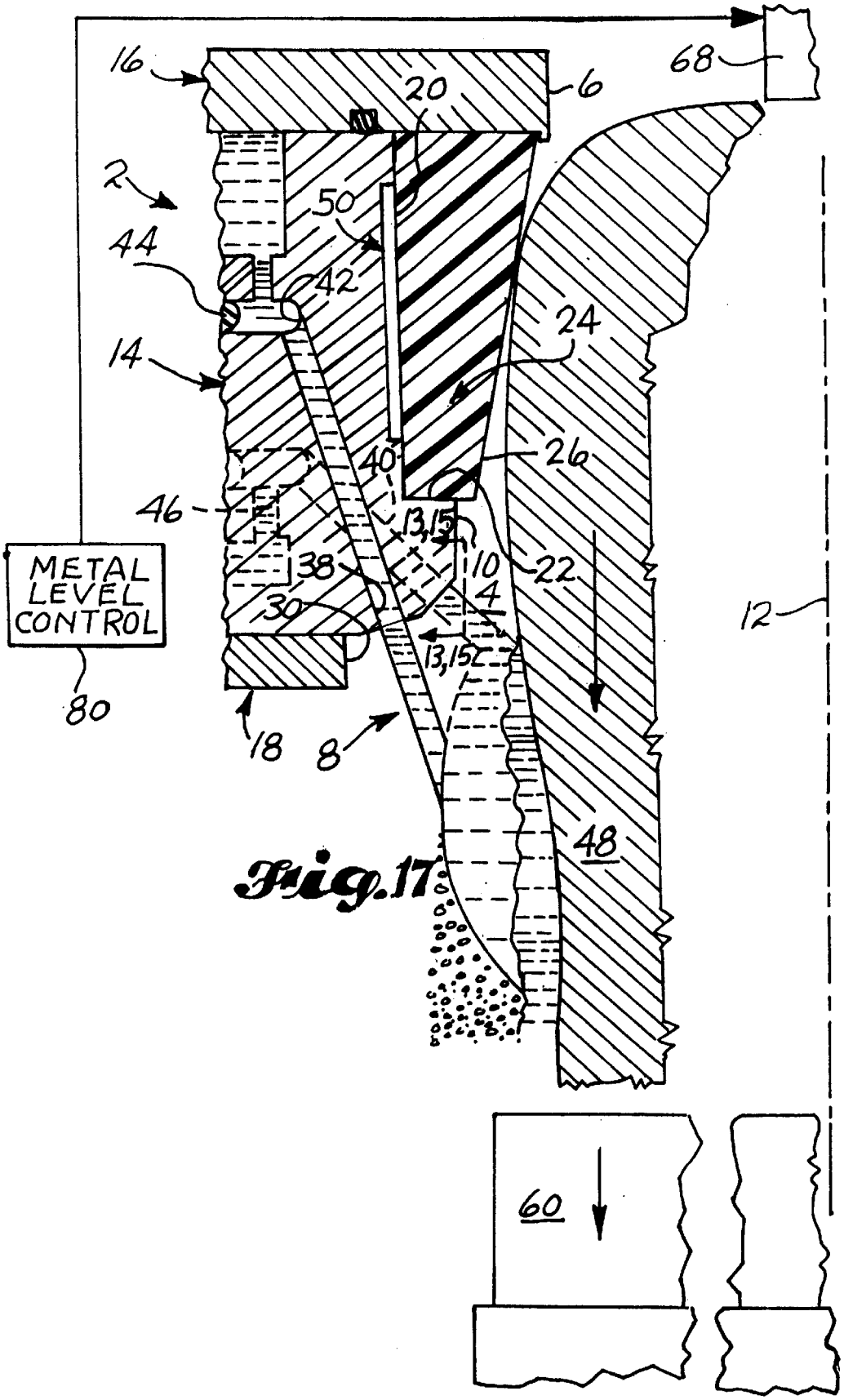
FIG. 17 is an axial cross section of either of the molds seen in FIGS. 9 and 10 and at the time when a casting operation is being conducted in the mold.
Figure 18:
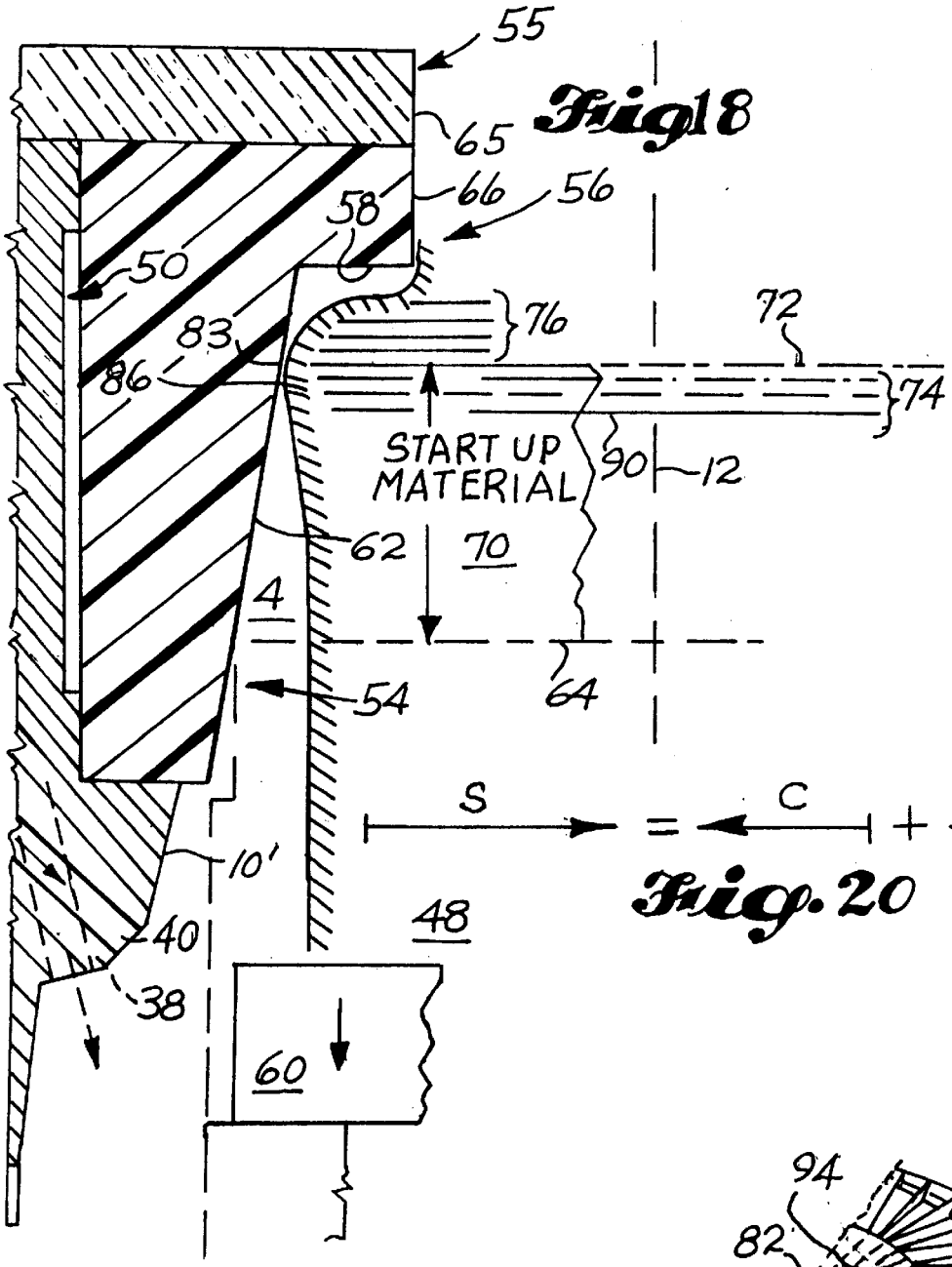
FIG. 18 is a hot topped version of the molds seen in FIGS. 9–15 and 17 at the time of use, and is accompanied by a schematic showing of certain principles employed in all of the molds.

Referring now to FIGS. 9–20, each of the desired shapes is produced in a mold 2 having an open ended cavity 4 therein, an opening 6 at the entry end of the cavity, and a series of liquid coolant discharge holes 8 circumposed about the discharge end opening 10 of the cavity. The axis 12 of the cavity may be oriented along a vertical line, or along an angle to a vertical line, such as along a horizontal line. The cross section seen in FIGS. 17 and 18 is typical, but typical only, in that as one traverses about the circumference of the cavity, certain features of the mold will vary, not so much in character, but in degree, as shall be explained. Orienting the axis 12 along an angle to a vertical line, will also produce changes, as those familiar with the casting art will understand. But in general terms, the vertical molds seen in FIGS. 9–15 and 17 each comprise an annular body 14 and a pair of annular top and bottom plates 16 and 18, respectively, which are attached to the top and bottom of the mold body, respectively. All three components are made of metal and have a shape in plan view corresponding to that of the body of metal to be cast in the cavity of the mold. In addition, the cavity 4 in the mold body 14 has an annular rabbet 20 thereabout of the same shape as the mold body itself, and the shoulder 22 of the rabbet is recessed well below the entry end opening 6 of the cavity, so that the rabbet can accommodate a graphite casting ring 24 of the same shape as that of the rabbet. The opening in the casting ring has a smaller cross sectional area at the top thereof than the discharge end opening 10 of the cavity, so that at its inner periphery, the ring overhangs the opening 10. The casting ring also has a smaller cross sectional area at the bottom thereof, so as to overhang the opening 10 at that level as well, and between the top and bottom levels of the casting ring, the inner periphery of it has a tapered skirt-like casting surface 26, the taper of which is directed relatively peripherally outwardly from the axis 12 of the cavity in the direction downwardly thereof The taper is also rectilinear in the embodiment shown, but may be curvilinear, as shall be explained more fully hereinafter. Typically, the taper has an inclination of about 1–12 degrees to the axis of the cavity, but in addition to varying in inclination from one embodiment of the invention to another, the taper may also vary in inclination as one traverses about the circumference of the cavity, as shall also be explained. The opening 6 in the top plate 16 has a smaller cross sectional area than those of the mold body 14 and the casting ring 24, so that when overlaid on the mold body and the ring as shown, and secured thereto by cap screws 28 or the like, the plate 16 has a slight lip overhanging the cavity at the inner periphery thereof. The opening 30 in the bottom plate 18 has the greatest cross sectional area of all, and in fact, is sufficiently large to allow for the formation of a pair of chamfered surfaces 32 and 34 about the bottom of the mold body, between the discharge end opening 10 of the cavity and the inner periphery of the plate 18.

At its inside, the mold body 14 has a pair of annular chambers 36 extending thereabout, and in order to use the so-called "machined baffle" and "split jet" techniques of U.S. Pat. Nos. 5,518,063, 5,685,359 and 5,582,230, the series of liquid coolant discharge holes 8 in the bottom of the inner peripheral portion of the mold body actually comprises two series of holes 38 and 40 which are acutely inclined to the axis 12 of the cavity 4 and open into the chamfered surfaces 32 and 34, respectively, of the mold body. At the tops thereof, the holes communicate with a pair of circumferential grooves 42 that are formed about the inner peripheries of the respective chambers 36, but are sealed therefrom by a pair of elastomer rings 44 so that they can form exit manifolds for the chambers. The manifolds are interconnected with the respective chambers 36 to receive coolant from the same through two circumferentially extending series of orifices 46 that also serve as a means for lowering the pressure of the coolant before it is discharged through the respective sets of holes 38 and 40. See U.S. Pat. No. 5,582,230 and U.S. Pat. No. 5,685,359 in this connection, which will also explain more fully the relative inclination of the sets of holes to one another and to the axis of the cavity, so that the more steeply inclined set of holes 38 generates spray as "bounce" from the body of metal 48, and then that spray is driven back onto the body of metal by the discharge from the other set of holes 40, in the manner schematically represented at the surface of the body of metal 48 in FIG. 17.

The mold 2 also has a number of additional components including several elastomer sealing rings, certain of which are shown at the joints between the mold body and the two plates. In addition, means are schematically shown at 50 for discharging oil and gas into the cavity 4 at the surface 26 of the casting ring 24, for the formation of an oil encompassed sleeve of gas (not shown) about the layers of molten metal in the casting operation, and U.S. Pat. No. 4,598,763 can be consulted for the details of the same. Likewise, U.S. Pat. No. 5,318,098 can be consulted for the details of a leak detection system schematically represented at 52.

In FIG. 18, the hot top mold 54 shown therein is substantially the same except that both the opening 52 of the hot top 55 and the upper half of the graphite casting ring 56 are sized to provide more of an overhang 58 than the ring 24 alone provides in FIGS. 9–15 and 17, so that the gas pocket needed for the technique of U.S. Pat. No. 4,598,763 is more pronounced.

When a casting operation is to be conducted with either the mold 2 of FIG. 17 or the mold 54 of FIG. 18, a reciprocable starter block 60 having the shape of the cavity 4 of the mold, is telescoped into the discharge end opening 10 or 10' of the mold until it engages the inclined inner peripheral surface 26 or 62 of the casting ring at a cross sectional plane of the cavity extending transverse the axis thereof and indicated at 64 in FIG. 18. Then, molten metal is supplied either to the opening 65 in the hot top of FIG. 18, or to a trough (not shown) above the cavity in FIG. 17; and the molten metal is delivered to the inside of the respective cavity either through the top opening 66 in the graphite ring of FIG. 18, or through a downspout 68 depending from the trough in the throat formed by the opening 6 in the top plate 16 of FIG. 17.

Initially, the starter block 60 is stationed at a standstill in the discharge end opening 10 or 10' of the cavity, while the molten metal is allowed to accumulate and form a body 70 of startup material on the top of the block. This body of startup material is typically accumulated to a "first" cross sectional plane of the cavity extending transverse the axis of cavity at 72 in FIG. 18. And this accumulation stage is commonly called the "butt-forming" or "start" stage of the casting operation. It is succeeded in turn by a second stage, the so-called "run" stage of the operation, and in this latter stage, the starter block 60 is lowered into a pit (not shown) below the mold, while the addition of molten metal to the cavity is continued above the block. Meanwhile, the body 70 of startup material is reciprocated in tandem with the starter block downwardly through a series of second cross sectional planes 74 of the cavity extending transverse the axis 12 thereof, and as it reciprocates through the series of planes, liquid coolant is discharged onto the body of material from the sets of holes 38 and 40, to direct cool the body of metal now tending to take shape on the block. In addition, a pressurized gas and oil are discharged into the cavity through the surface of the graphite ring, using the means indicated generally at 50 in each of FIGS. 17 and 18.

As can be best seen in FIG. 18, the molten metal discharge forms layers 76 of molten metal which are successively superimposed on the top of the body 70 of startup material, and at a point directly below the top opening of the graphite ring, and adjacent the first cross sectional plane 72 of the cavity. Typically, this point is central of the mold cavity, and in the case of one which is symmetrically or asymmetrically noncircular, is typically coincident with the "thermal shed plane" 78 (FIGS. 10 and 24) of the cavity, a term which will be explained more fully hereinafter. The molten metal may also be discharged into the cavity at two or more points therein, depending again on the cross sectional shape of the cavity, and the molten metal supply procedure followed in the casting operation. But in any case, when the layers 76 are superimposed on the body 70 of startup material, adjacent the first cross sectional plane 72 of the cavity, the respective layers undergo certain hydrodynamics, and particularly when each encounters an object, liquid or solid, which diverts it from its course axially of the cavity, or relatively peripherally outwardly thereof, as shall be explained.

The successive layers actually form a stream of molten metal, and as such, the layers have certain hydrodynamic forces acting on them, and these forces are characterized herein as "splaying forces" "S" (FIG. 20) acting relatively peripherally outwardly from the axis 12 of the cavity adjacent the first cross sectional plane 72 thereof That is, the forces tend to splay the molten metal material in that direction, and so to speak, "drive" the molten metal into contact with the surface 26 or 62 of the graphite ring. The magnitude of the splaying forces is a function of many factors, including the hydrostatic forces inherent in the molten metal stream at the point at which each layer of molten metal is superimposed on the body of startup material, or on the layers preceding it in the stream. Other factors include the temperature of the molten metal, the composition of it, and the rate at which the molten metal is delivered to the cavity. A control means for controlling the rate is schematically shown at 80 in FIG. 17. See also in this connection, U.S. Pat. No. 5,709,260. The splaying forces may not be uniform in all angular directions from the point of delivery, and of course, in the case of a horizontal or other angular mold, they cannot be expected to be equal in all directions. But as shall be explained, the invention takes this fact into account, and may even capitalize on it in certain embodiments of the invention.

As each layer 76 of molten metal approaches the surface 26 or 62 of the graphite ring, certain additional forces begin to take effect, including the physical forces of viscosity, surface tension, and capillarity. These in turn give the surface of the layer an obliquely inclined wetting angle to the surface 26 or 62 of the ring, as well as to the first cross sectional plane 72 of the cavity. On contacting the surface, certain thermal effects also take effect, and these effects generate in turn ever-enlarging thermal contraction forces "C" (FIG. 20) in the molten metal, that is, forces counter to the splaying forces and tending to shrink the metal relatively peripherally inwardly of the axis, rather than outwardly thereof But though ever-enlarging, these contraction forces are relatively late in coming, and given a suitable rate of delivery and a mold cavity wherein the splaying forces exceed the thermal contraction forces in the layer when the layer contacts the surface 26 or 62 of the ring in the first cross sectional plane 72 of the cavity, there will be considerable "driving power" remaining in the splaying forces as the layer takes on the first cross sectional area 82 (FIG. 19) circumscribed for it by the annulus 83 (FIG. 18) of the surface in that plane. It is only natural then, that as the layer makes contact with the surface of the ring, it will be readily directed into the series of second cross sectional planes 74 of the cavity, not only by the inclination of the surface 26 or 62 to the axis of the cavity, but also by the natural inclination of the layer to follow the obliquely angled course set for it by the physical forces mentioned earlier. However, were the surface 26 or 62 at right angles to the first cross sectional plane of the cavity, as was the case in the prior art, then the surface would oppose that tendency, and instead of lending itself to the natural inclinations of the layer, would frustrate them, leaving the layer no other choice than to make the right angular turn required of it and to roil itself along the surface as best it could, parallel to the axis, while maintaining close contact with the surface. This contact would lead in turn to friction, and that friction has been the bane of every mold designer, causing him or her to seek ways to overcome it, or to separate the layers from the surface so as to minimize the role friction plays between them. Of course, friction suggests the use of lubricants, and lubricants have been employed in great numbers. As indicated earlier, however, there is intense heat flowing between the layers and the surface, and the lubricants themselves have posed a different kind of problem in that the intense heat tends to decompose a lubricant, and often the products of its decomposition react with the air at the interface between the layers and the surface, and produce metal oxides or the like which in turn become particle-like "rippers" (not shown) at the interface, that produce so-called "zippers" along the axial dimension of any product produced in this way. Therefore, while lubricants have reduced the effects of friction, they have produced a different kind of problem for which no solution has been developed as yet.

Returning now to FIGS. 18–20, note that at the circumference 84 (FIG. 19) of the first cross sectional area 82, each layer is not only directed headlong into the series of second cross sectional planes 74 of the cavity, but also allowed to take on second cross sectional areas 85 therein which have progressively peripherally outwardly greater cross sectional dimensions in the second cross sectional planes 74 corresponding thereto. The layer is never free, however, to "bleed" out of control in those planes, but instead, is at all times under the control of the baffling means provided by the annuli 86 at the surface 26 or 62 of the ring in the respective second cross sectional planes 74 of the cavity. The annuli 86 operate to confine the continued relatively peripheral outward distention of the layer, and to define the circumferential outlines 88 of the second cross sectional areas 85 taken on by the layer in the planes 74. But because of their relatively peripherally outwardly inclined angles to the axis 12, and their relatively peripherally outwardly staggered relationship to one another, they do so "retractively," or passively, so that the layer can assume progressively relatively peripherally outwardly greater cross sectional dimensions in the respective second planes corresponding thereto, as indicated. Meanwhile, the thermal contraction forces "C" (FIG. 20) arising in the layer begin to counter the splaying forces remaining in it and ultimately, to counterbalance the splaying forces altogether, so that when they have done so, the retractive baffling effect "R" in the equation of FIG. 20 may, so to speak, drop out of the equation. That is, baffling will no longer be needed. "Solidus" will have occurred and the body of metal 48 will be in effect a body capable of sustaining its own form, although it will continue to undergo a certain degree of shrinkage, transverse the axis of the cavity, and this can be seen in FIG. 18, below the "one" second cross sectional plane 90 of the cavity in which the counterbalancing effect had occurred, that is, in which "solidus" had taken place.

Figure 19:
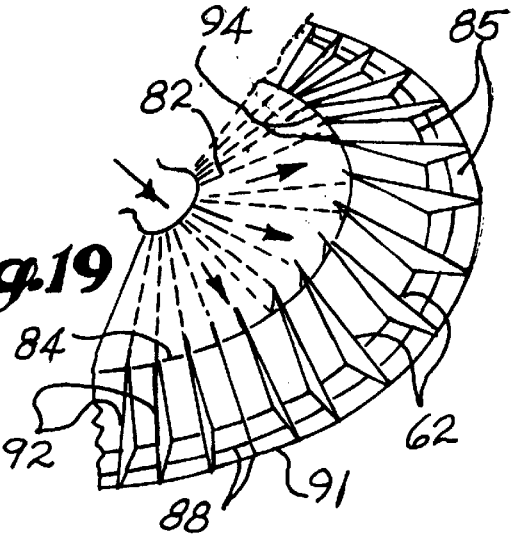
FIG. 19 is a schematic representation of the principles, but using a set of angularly successive diagonals to represent the casting surface of each mold, so that certain areas and outlines can be seen therebelow in the Figure.

Referring once again to FIGS. 1–8, and in conjunction with FIG. 19, it will be seen that in the case of each shape, "solidus" is represented by the outside circumferential outline 91 of the shape, whereas the relatively inside outline 84 is that of the first cross sectional area 82 given each layer by the annulus 83 in the first cross sectional plane 72 of the cavity. And the "penumbra" between each pair of outlines is the progressively larger second cross sectional area 85 taken on by the respective layers before "solidus" occurs at plane 90.

The surface 26 or 62 of each ring has angularly successive part annular portions 92 (between the diagonals of FIG. 19 representing the surface) arrayed about the circumference thereof, and if the circumferential outline of the surface is circular, the angle of its taper is the same throughout the circumference of the surface, the axis 12 of the cavity is oriented along a vertical line, and heat is uniformly extracted from the respective angularly successive part annular portions 94 (FIGS. 10 and 19) of the layers about the circumferences thereof, then the body of metal will likewise assume a circular outline about the cross sectional area thereof in the plane 90. That is, if a vertical billet casting mold is used, the surface 26 or 62 of it is given these characteristics, and the heat extraction means 8 including the "split jet" system of holes, 38, 40, are operated to extract heat from the respective portions 94 of the billet at a uniform rate about the circumference thereof, then in effect, the annulus 83 will confer a circular circumferential outline 84 on the first cross sectional area 82 therewithin, the annuli 86 will confer similar circumferential outlines 88 on the respective second cross sectional areas 85 therewithin, and the body of metal will prove to be cylindrical, since any thermal stresses generated in the body crosswise thereof in third cross sectional planes 95 (FIG. 9 and the diagonals representing the surface 26 or 62 in FIG. 19) of the cavity extending parallel to the axis thereof between portions 94 of the body on mutually opposing sides of the cavity, will tend to balance one another from side to side of the cavity. But when, a noncircular circumferential outline is chosen for the body of metal at the plane 90, or the axis of the mold is oriented at an angle to a vertical line, or heat is extracted from the portions 94 at a non-uniform rate, then various controls must be introduced with respect to several features of the invention.

Firstly, some way must be provided for balancing the thermal stresses in the third cross sectional planes 95 of the cavity. Secondly, the layers 76 of molten metal must be allowed to transition through the series of second cross sectional planes 74, at cross sectional areas 85 and circumferential outlines 88 which are suited to the cross sectional area and circumferential outline intended for the body of metal in plane 90. This means that a cross sectional area 82 and circumferential outline 84 suited to that end, must be chosen for the first cross sectional plane 72. It also means that if the outline is to be reproduced at plane 90, though the area of the body of metal in that plane will be larger, then some way must be provided to account for variances in the differentials existing between the splaying forces "S" and the thermal contraction forces "C" in angularly successive part angular portions 94 of the layers on mutually opposing sides of the cavity.

Ways have been developed with which to control each of these parameters, including ways, if desired, with which to create a variance among the parameters, so that from commonplace first cross sectional areas and/or circumferential outlines, such as circular ones, shapes can be formed which are akin to but unlike those areas or outlines, such as ovals. Ways have also been developed for controlling the size of the cross sectional area of the body of metal in the plane 90. Each of these control mechanisms will now be explained.

Figure 9:
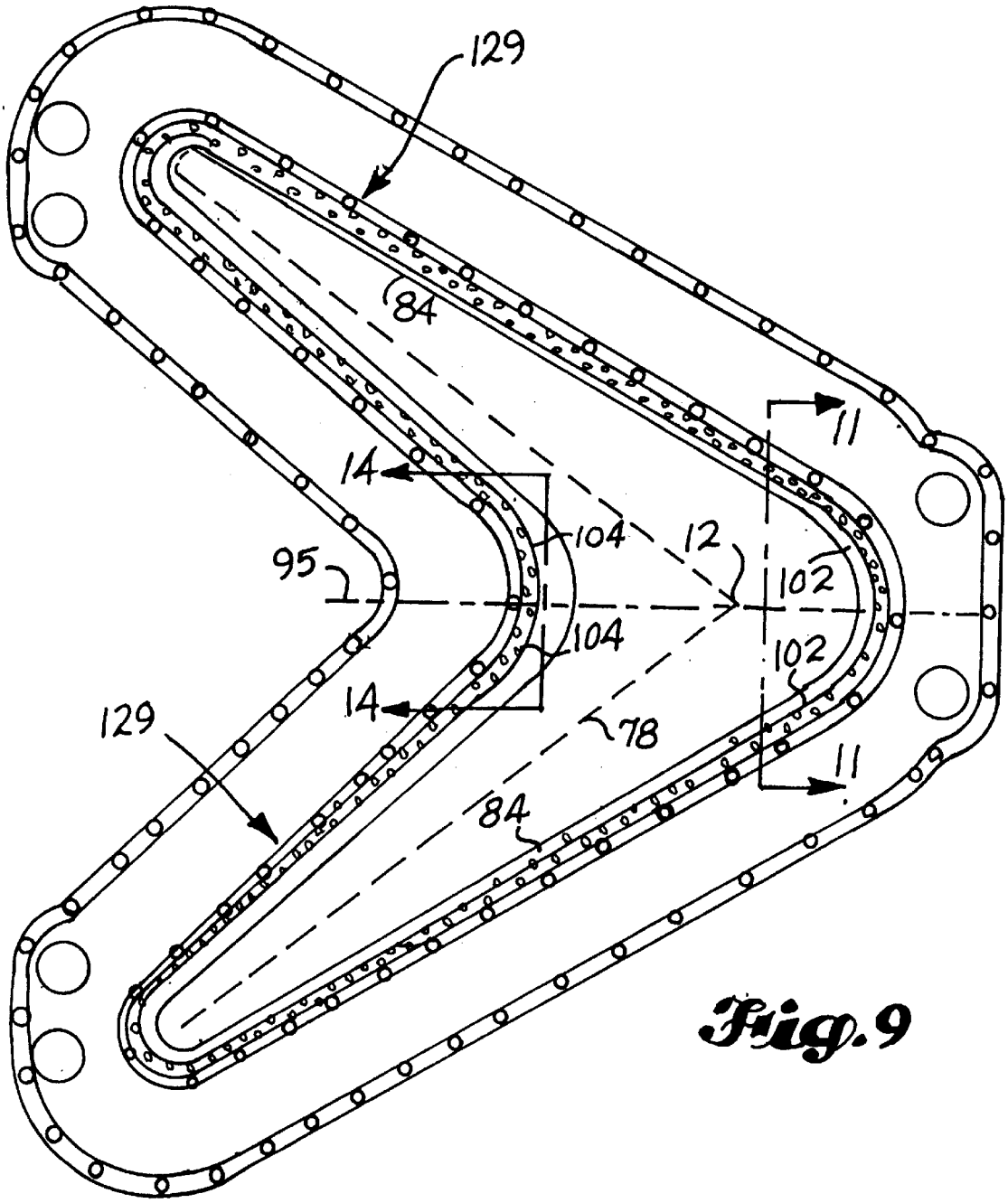
FIG. 9 is a bottom plan view of an open-topped vertical mold for casting a V-shaped body of metal such as that seen in FIG. 4, and showing in addition, the circumferential outline of the first cross sectional area in the cavity of the mold.
Figure 10:
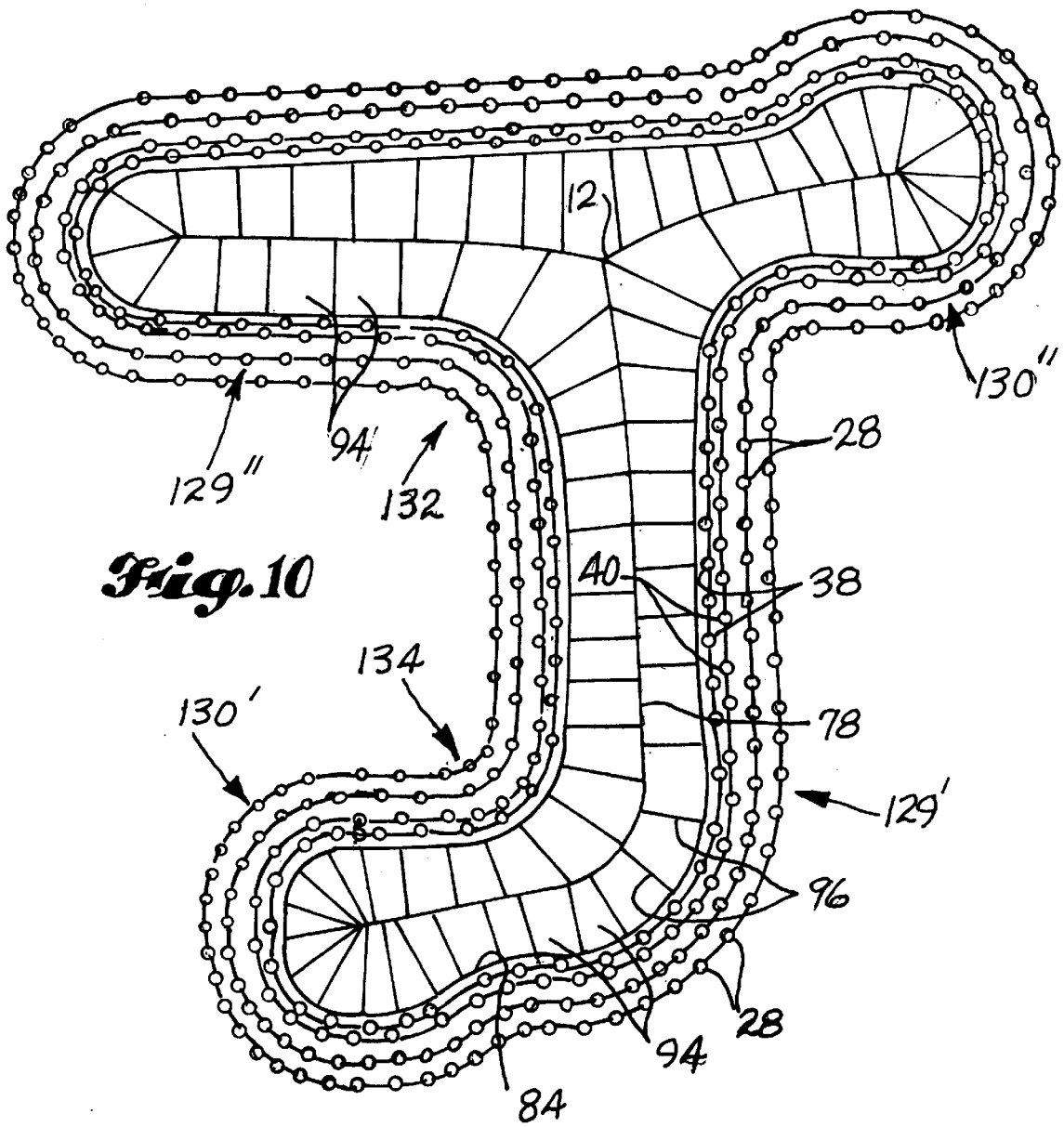
FIG. 10 is a similar view of an open-topped vertical mold for casting a sinuous asymmetrical noncircular body of metal such as the generally L-shaped one seen in FIG. 5, but showing now within the cavity of the mold, the theoretical basis for the scheme employed in varying the rate at which heat is extracted from the angularly successive part annular portions of the body of metal to balance the thermal stresses arising between mutually opposing portions thereof in cross sectional planes of the cavity extending parallel to the axis thereof.
Figure 11:
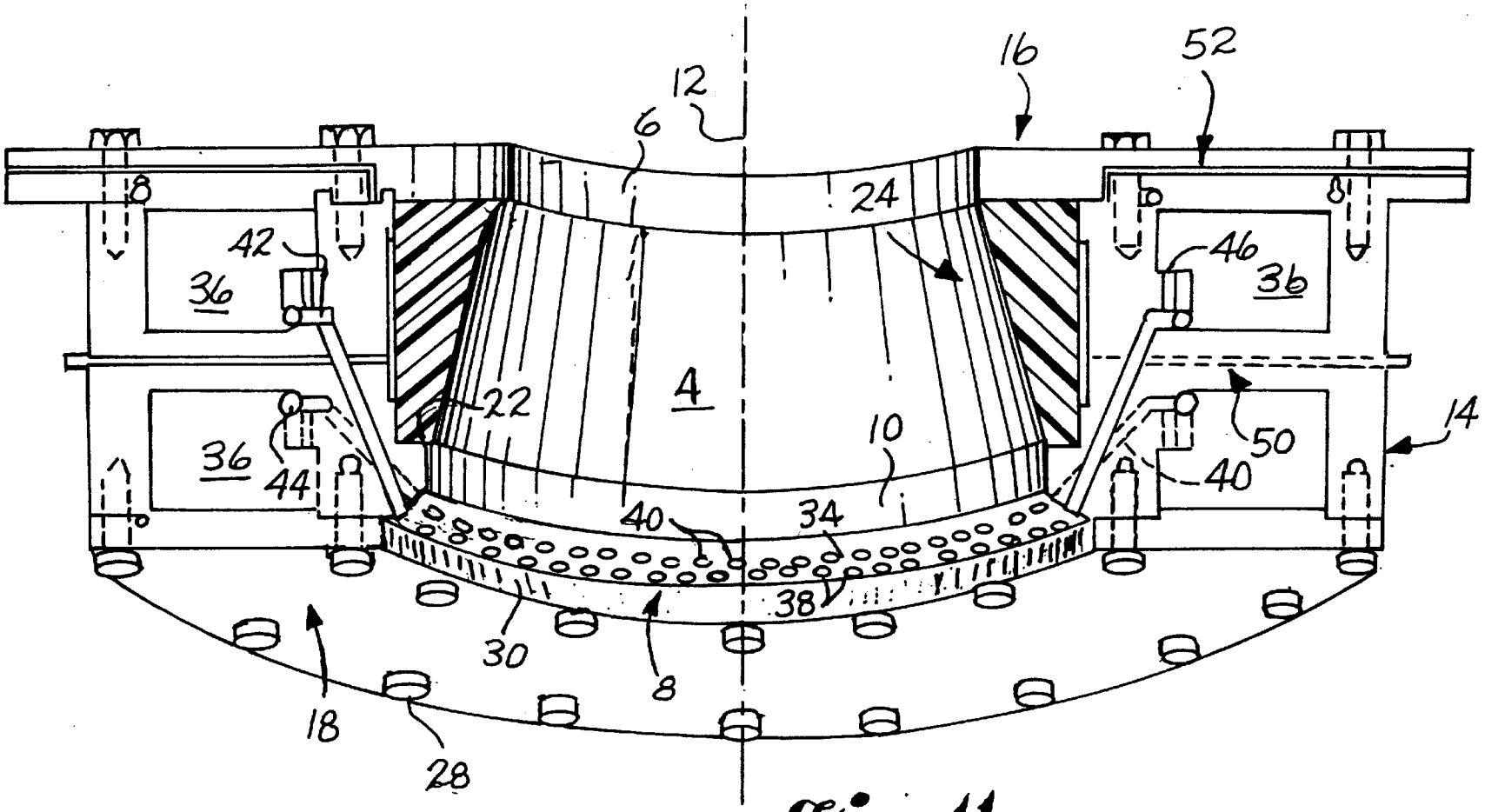
FIG. 11 is an isometric cross section along the line 11—11 of FIG. 9.
Figure 12:
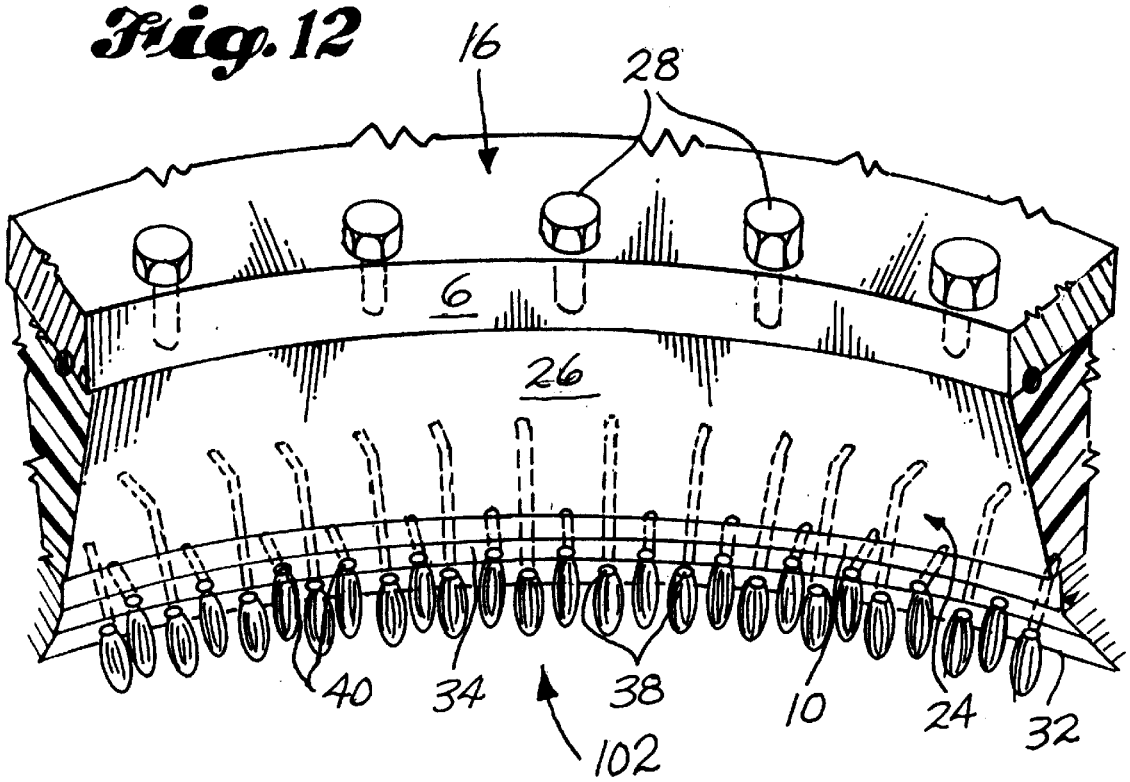
FIG. 12 is a relatively enlarged and more steeply angled part schematic isometric cross section showing the center portion of the isometric cross section seen in FIG. 11.
Figure 14:
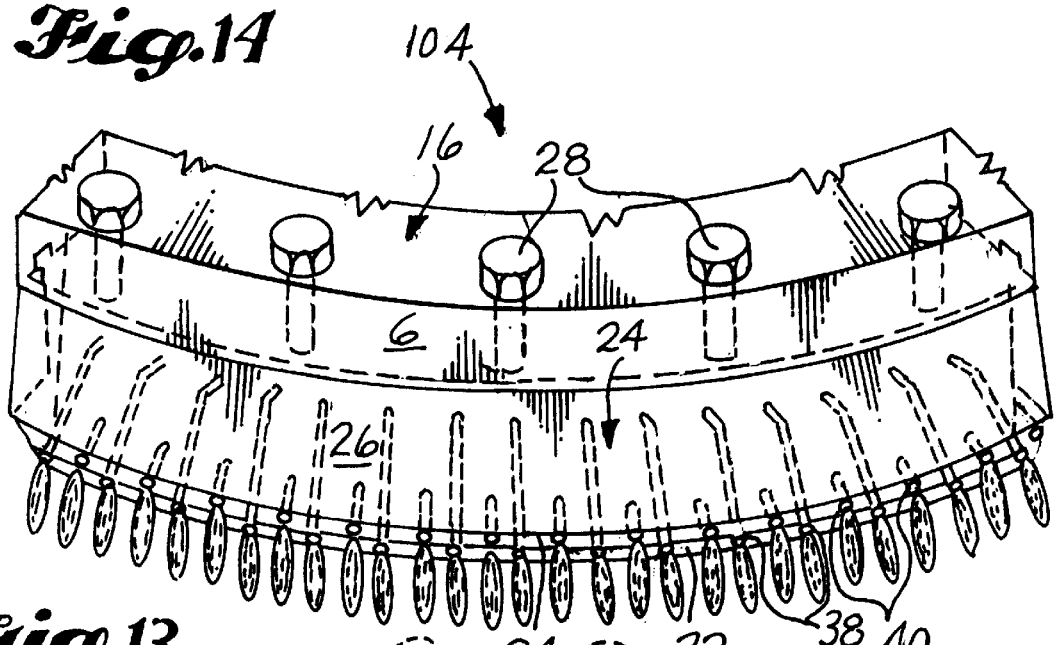
FIG. 14 is an isometric part schematic cross section along the line 14—14 of FIG. 9 and like that of FIG. 12, more enlarged and steeply inclined than the isometric cross section of FIG. 11.
Figure 13:
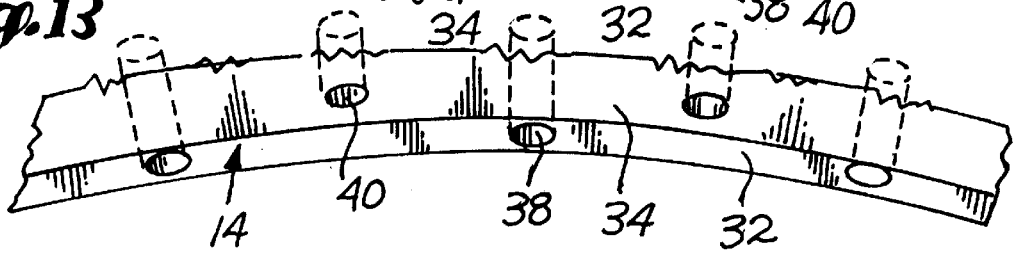
FIG. 13 is a cross section along the line 13, 15—13, 15 of FIG. 17, showing the two series of coolant discharge holes employed in extracting heat from the angularly successive part annular portions of the body of metal occupying a relatively concave bight in FIGS. 9, 11 and 12, and particularly for comparison with the two series of holes to be shown in this connection in FIG. 15 hereafter.
Figure 15:
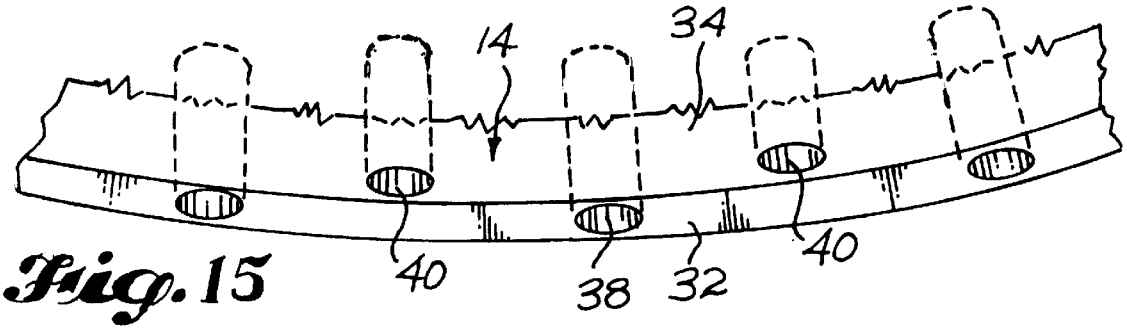
FIG. 15 is another cross section along the line 13, 15—13, 15 of FIG. 17 showing the two series of coolant discharge holes employed for heat extraction in a relatively convex bight in FIG. 14, and in this instance, for comparison with the two series shown at the concave bight of FIG. 13, as mentioned earlier.

As for balancing the thermal stresses, reference should be made firstly to FIG. 10 and then to the remainder of FIGS. 9–15 as well. To control the thermal stresses in any noncircular cross section, such as the asymmetrical noncircular cross section seen in FIG. 10, first the respective angularly successive part annular portions 94 of the body of metal are plotted by extending normals 96 into the thermal shed plane 78 from the circumferential outline 84 of the cross section, and at substantially regular intervals thereabout. Then, in fabricating the mold itself, provision is made for discharging variable amounts of liquid coolant onto the respective portions 94 so that the rate of heat extraction from portions on mutually opposing sides of the outline is such that the thermal stresses arising from the contraction of the metal, will tend to be balanced from side to side of the body. Or put another way, coolant is discharged about the body of metal in amounts adapted to equalize the thermal contraction forces in the respective mutually opposing portions of the body.

Figure 24:
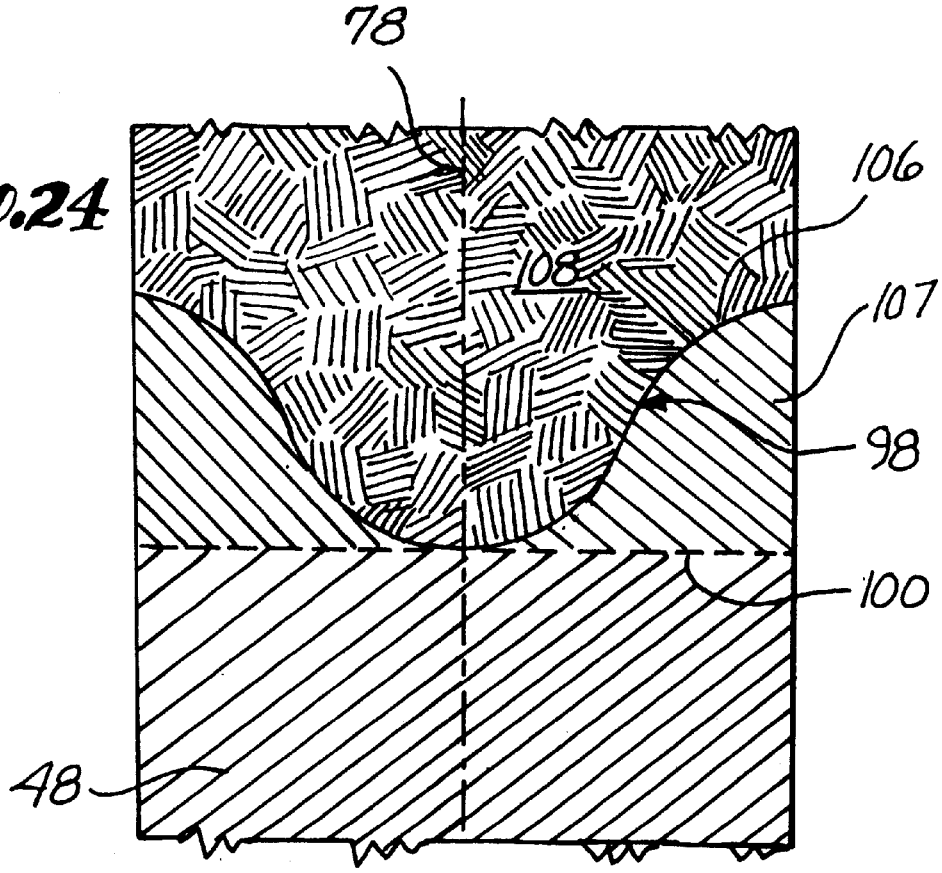
FIG. 24 is a thermal cross section through a typical casting, showing the trough-shaped model of successively convergent isotherms therein and the thermal shed plane thereof.

The "thermal shed plane" (FIG. 24) is that vertical plane coinciding with the line of maximum thermal convergence in the trough-shaped model 98 defined by the successively converging isotherms of any body of metal. Put another way, and as seen in FIG. 24, it is the vertical plane coinciding with the cross sectional plane 100 of the cavity at the bottom of the model, and in theory, is the plane to the opposing sides of which heat is discharged from the body of metal to the outline thereof.

To vary the amount of coolant discharged onto the portions 94, the hole sizes of the individual holes 38 and 40 in the respective sets thereof are varied in relation to one another. Compare the hole sizes in FIGS. 13 and 15 for the holes 38, 40 disposed adjacent the mutually opposing convexo/concave bights 102 and 104 of the cavity seen in FIG. 9. At bights such as these, severe stresses can be expected unless such a measure is taken. Other ways can be adopted to control the rate of heat extraction, however, such as by varying the numbers of holes at any one point on the circumference of the cavity, or varying the temperature from point to point, or by some other strategy which will have the same effect.

Preferably, the coolant is discharged onto the body of metal 48 (FIG. 24) so as to impact the same between the cross sectional plane 100 of the cavity at the bottom of the model 98 and the plane at the rim 106 thereof, and preferably, as close as possible to the latter plane, such as onto the "cap" 107 of partially solidified metal formed about the mush 108 in the trough of the model.

Figure 21:
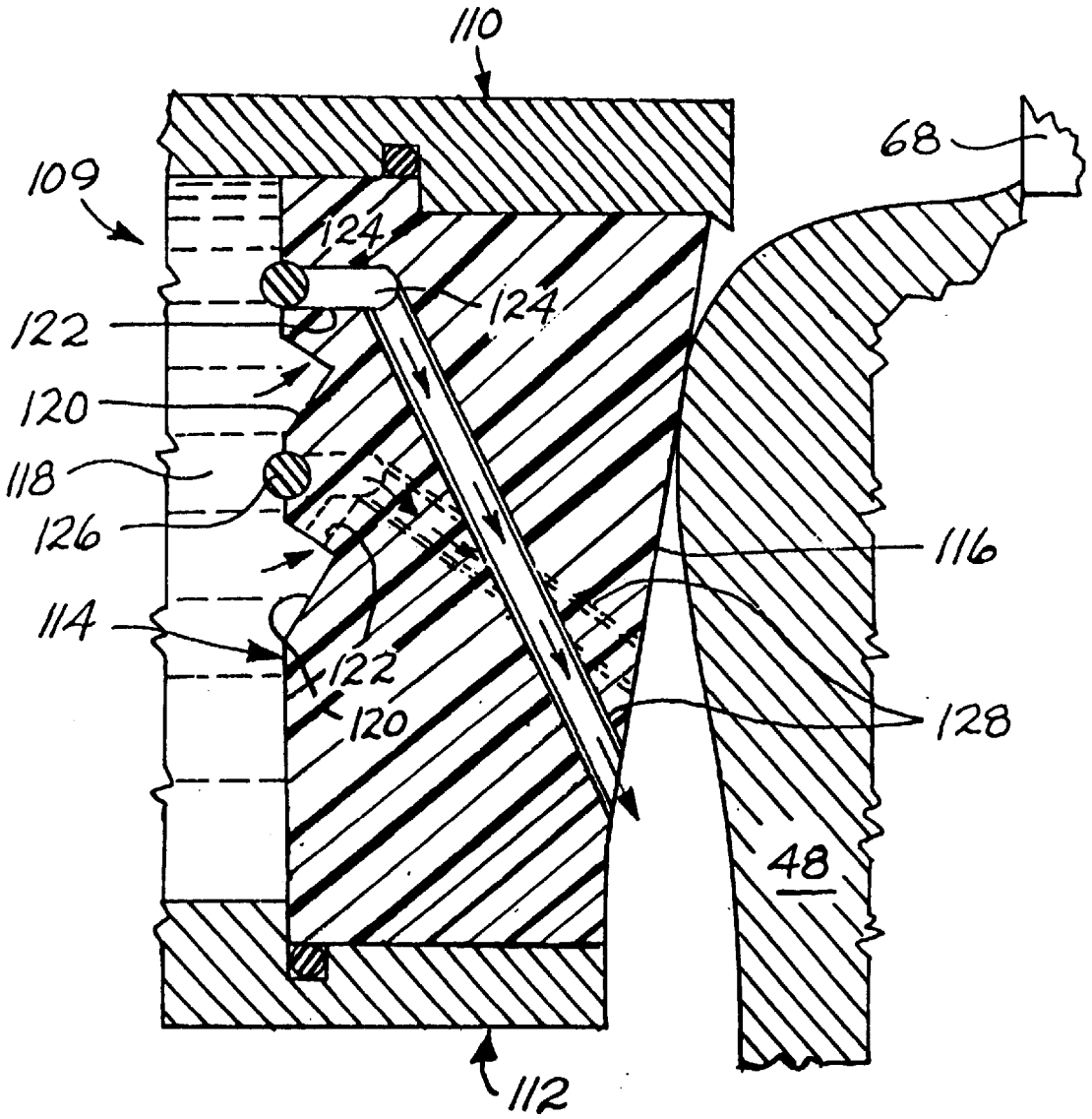
FIG. 21 is a view similar to that of FIGS. 17 and 18, but showing a modified form of mold which provides for the coolant being discharged directly into the cavity of the mold.

Depending on the casting speed, this may even mean discharging the coolant through the graphite ring and into the cavity, as seen through the cross section of FIG. 21. In this instance, the mold 109 comprises a pair of top and bottom plates 110 and 112, respectively, which are cooperatively rabbeted to capture a graphite ring 114 therebetween. The ring 114 is operable not only to form the casting surface 116 of the mold, but also to form the inner periphery of an annular coolant chamber 118 arranged about the outer periphery thereof The ring has a pair of circumferential grooves 120 about the outer periphery thereof, and the grooves are chamfered at the tops and bottoms thereof to provide suitable annuli for series of orifices 122 discharging into an additional pair of circumferential grooves 124 suitably closed with elastomer sealing rings 126 at the outer peripheries thereof. The grooves 124 discharge in turn into two sets of holes 128 which are arranged about the axis of the cavity to discharge into the same in the manner of U.S. Pat. No. 5,582,230 and U.S. Pat. No. 5,685,359. The holes 128 are commonly varnished or otherwise coated to contain the coolant in its passage therethrough, and once again, sealing rings are employed between the respective plates and the graphite ring to seal the chamber from the cavity.

To derive the area 82, outline 84, and "penumbra" 85 needed to cast a product having a noncircular area and outline 91, a process is used which can be best described with reference to FIGS. 9 and 10. Each provides an opportunity to evaluate a noncircular circumferential outline and the curvilinear and/or anglolinear "arms" 129 extending peripherally outwardly from the axis 12 therewithin. The arms 129 also have contours therewithin which are curvilinear and/or anglolinear, and opposing contours therebetween which are convexo/concave. Therefore, if one chooses to traverse the cavity in any third cross sectional plane 95 thereof, he/she will find that the contours on the opposing sides of the cavity are likely to generate a variance between the differentials existing in the mutually opposing angularly successive part annular portions 94 of the layers on those sides. For example, the angularly successive part annular portions of the layers disposed opposite the bights 102 and 104 of FIG. 9 will experience dramatically different splaying forces in the casting of the "V." At the relatively concave bight 102, the molten metal in the portions 94 will tend to experience compression, "pinching" or "bunching up," because under the dynamics of the casting operation, the two arms 129 of the "V" will tend to rotate toward one another, and in effect compress or "crowd" the metal in the bight 102. On the other, hand, at the relatively convex bight 104, the rotation of the arms will tend to relax or open up the metal in the portions thereopposite, so that a wide variance will arise between the differentials existing between the splaying forces and the thermal contraction forces in the respective portions. The same is true in FIG. 10, but compounded by the presence of arms 129 which have appendages 130 thereon in turn. After start, the arm 129', for example, tends to rotate in the clockwise direction of FIG. 10, whereas the arm 129" tends to rotate in the counterclockwise direction. Meanwhile, the appendage 130' on the arm 129' and the appendage 130" on the arm 129" tend to also rotate counter directionally. Each dynamic has an effect on the hydrodynamics of the metal in the convexo/concave bights 132 or 134 extending therebetween; while on the other hand, there are points on the outline of the Figure which actually experience little consequence from the rotation of the respective arms or appendages, such as points on the tips of the respective arms or appendages.

Figure 20:
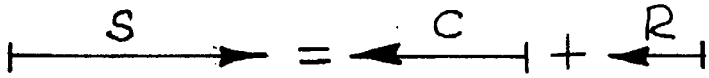
FIG. 20 is an arithmetic representation of certain principles.

To neutralize the various variances, and to account for the contraction that each arm 129 is also experiencing lengthwise thereof, the taper of the respective angularly successive part annular portions 92 (FIG. 19) of the surface 26 or 62 of the casting ring disposed opposite the portions 94, is varied so as to vary the "R" factor in the equation of FIG. 20 to the extent that the splaying forces in the respective portions 94 of the layers have an equal opportunity to spend themselves in the respective angularly successive part annular portions of the second cross sectional areas 85 disposed thereopposite. Note for example, that the concave bight 104 in FIG. 9 has a wide part annular segment of the "penumbra" 85 to account for the higher splaying forces therein, whereas the convex bight 102 thereopposite has a far narrower segment of the "penumbra," because of the relatively lower splaying forces experienced by the portions of the layers thereopposite. The outline of FIG. 10 is put through similar considerations, usually in a multistage process that addresses the contraction and/or rotation each arm or appendage will experience in the casting process, and then extrapolates between adjacent effects to choose a taper meeting the needs of the higher effect. If, for example, one of two adjacent effects requires a five degree taper, and another a seven degree taper, then the seven degree taper would be chosen to accommodate both effects. The result is schematically shown in the "penumbras" 85 of FIGS. 4 and 5, and a close examination of them is recommended to understand the process used.

Of course, it is the cross sectional area and outline seen at 91 in each case, that is desired from the process. Therefore, the process is actually conducted in the reverse direction, to derive a "penumbra" first which will in turn dictate the cross sectional outline 84 and cross sectional area 82 needed for the opening in the entry end of the mold.

Using a variable taper as a control mechanism, it is also possible to cast cylindrical billet in a horizontal mold from a cavity having a cylindrical circumferential outline about the first cross sectional area thereof See FIGS. 2 and 7, as well as FIG. 16, and note that to do so, the cavity 136 must have a sizable swale 85 in the bottom thereof, between the outline 84 of the first cross sectional area 82 and the circumferential outline 91 conferred on the body of metal in the plane 90. This is represented schematically in FIG. 16 which shows the size differentiation needed between the angles of the casting surface at the top 138 and bottom 140 of the mold 142 for this effect alone.

Figure 25:
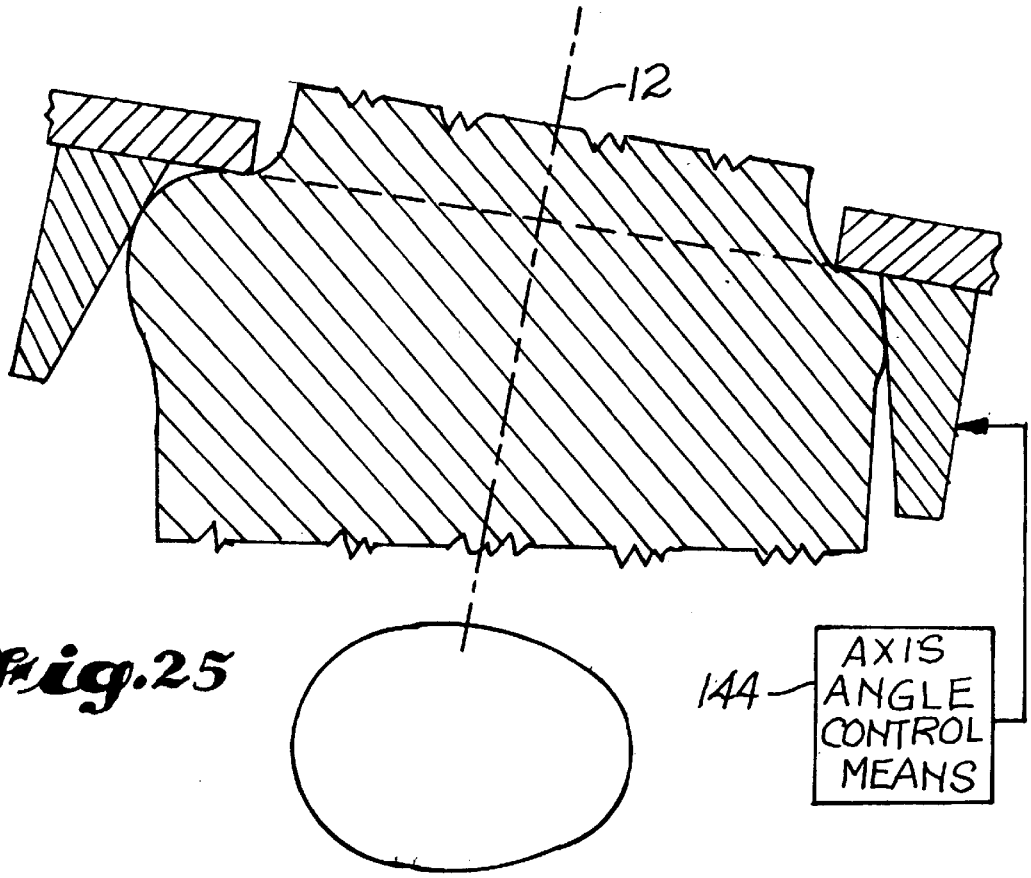
FIG. 25 is a schematic representation of a way to generate an oval or other symmetrical noncircular circumferential outline, from a first cross sectional area of circular outline, by tilting the axis of the mold.
Figure 26:
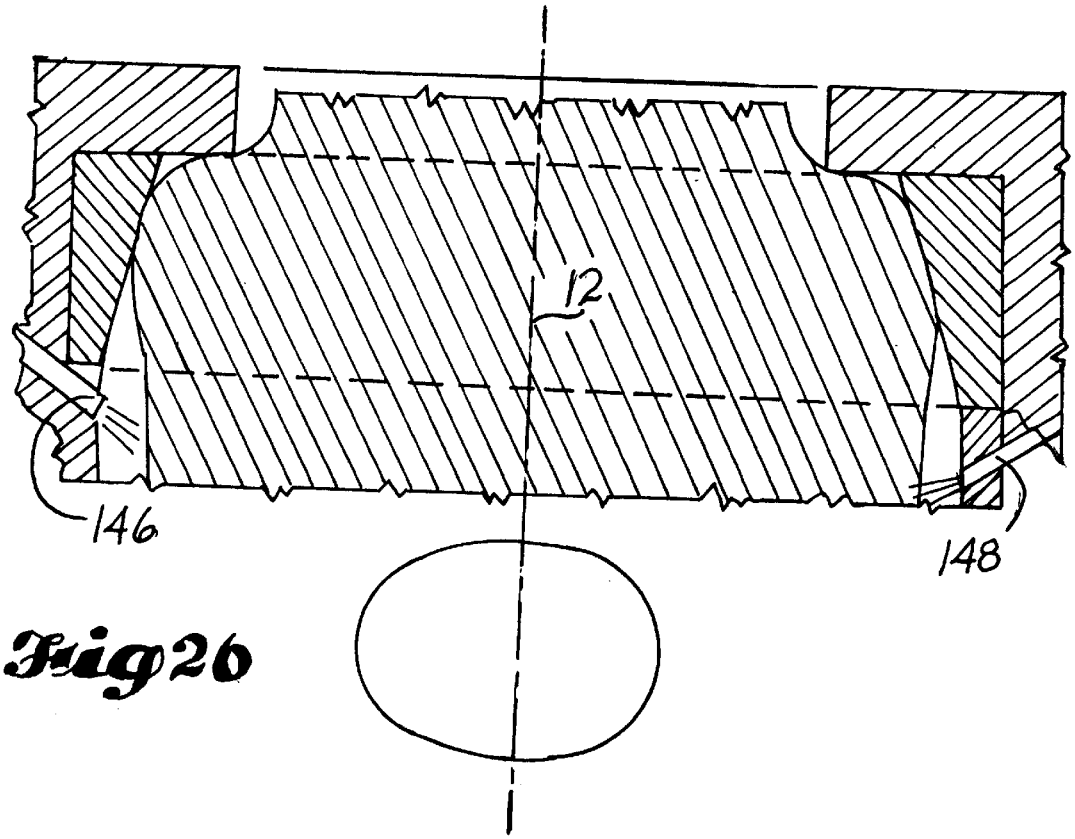
FIG. 26 is a schematic representation of another way of doing so by varying the rate at which heat is extracted from angularly successive part annular portions of the body of metal on opposing sides of the mold.
Figure 27:
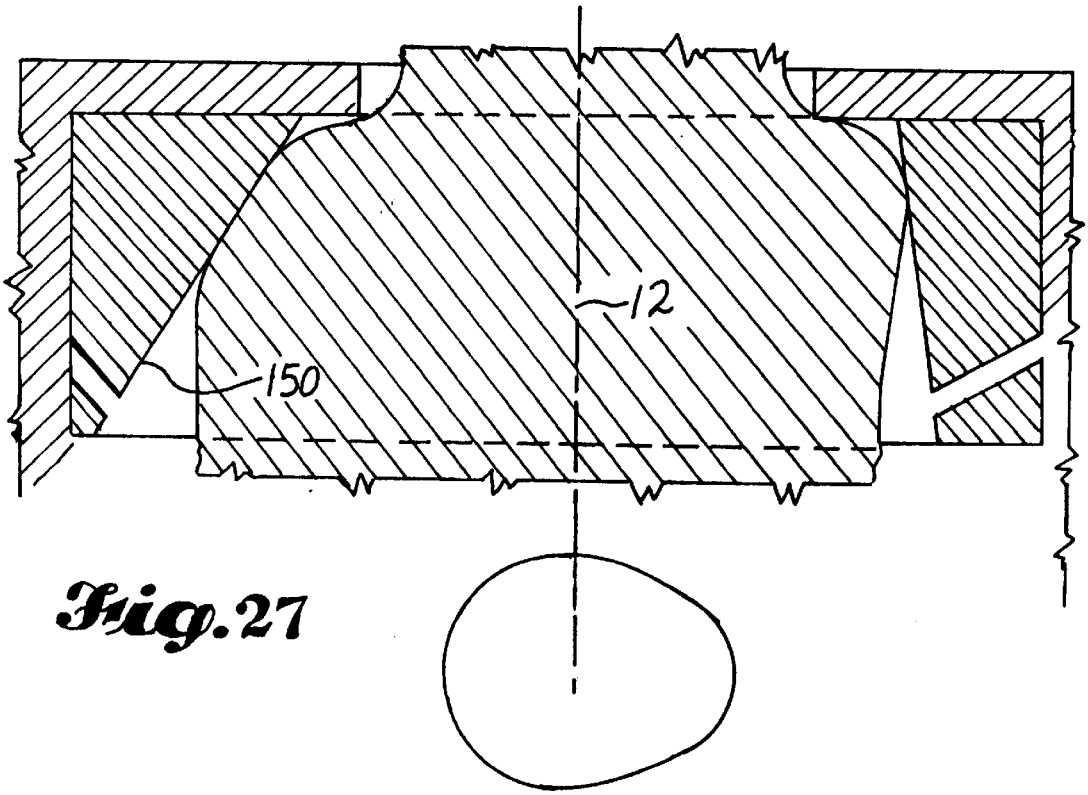
FIG. 27 is a schematic representation of a third way of generating an oval or other symmetrical noncircular circumferential outline from a first cross sectional area of circular outline, by varying the inclination of the casting surface on opposing sides of the mold.

There are times, however, when it is advantageous to create a variance between the differentials on mutually opposing sides of the cavity by way of turning a commonplace circumferential outline into some other outline, such as a circular outline into an oval or oblate outline. In FIG. 25, conventional axis orientation control means 144 have been employed to tilt the axis of the cavity at an angle to a vertical line, so that such a variance will convert a circular outline 84 about the first cross sectional area 82 of the cavity, into symmetrical noncircular outlines for the second cross sectional areas 85 thereof, and thus for the circumferential outline of the cross section of the body of metal in the one second cross sectional plane 90 of the cavity in which "solidus" occurs. In FIG. 26, such a variance is created by varying the rate at which heat is extracted from the angularly successive part annular portions 94 of the body of metal on mutually opposing sides thereof See the variance in the size of the holes 146 and 148. And in FIG. 27, the surface 150 of the graphite ring has been given differing inclinations to the axis of the cavity on mutually opposing sides thereof to create such a variance. In each case, the effect is to produce an oval or oblate circumferential outline for the cross section of the body of metal, as is schematically represented at the bottom of FIGS. 25–27.

Figure 22:
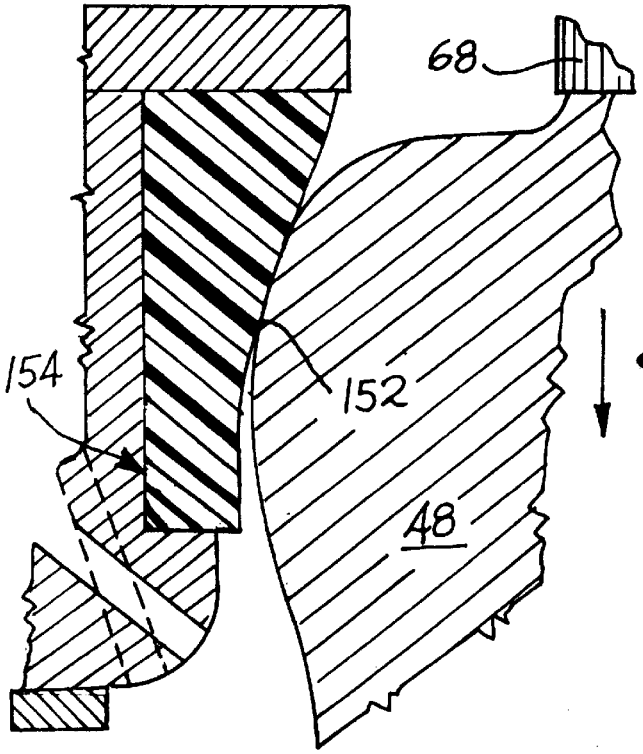
FIG. 22 is an abbreviated axial cross section like that of FIG. 17, but showing a casting ring with a curvilinear casting surface to capture "rebleed;"

The surface of the ring may be given a curvilinear flare or taper, rather than a rectilinear one. In FIG. 22, the surface 152 of the ring 154 is not only curvilinear, but also curved somewhat reentrantly toward a parallel with the axis, below the series of second cross sectional planes 74, and below plane 90 in particular, for purposes of capturing any "rebleed" occurring after "solidus" has occurred. Ideally, in each instance, the casting surface follows every movement of the metal, but just ahead of the same, to lead but also control the progressive peripheral outward development of the metal.

Figure 28:
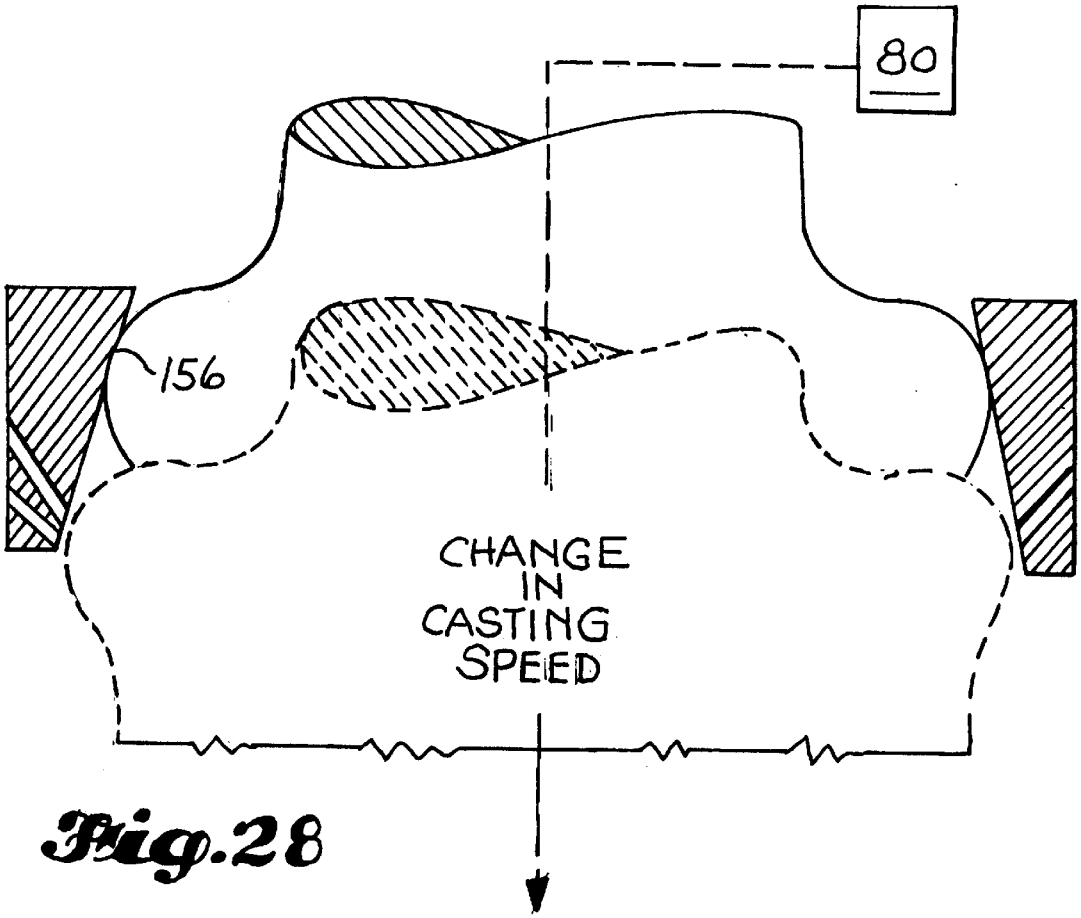
FIG. 28 is a schematic representation of a way of varying the cross sectional dimensions of the cross sectional area of a casting.
Figure 29:
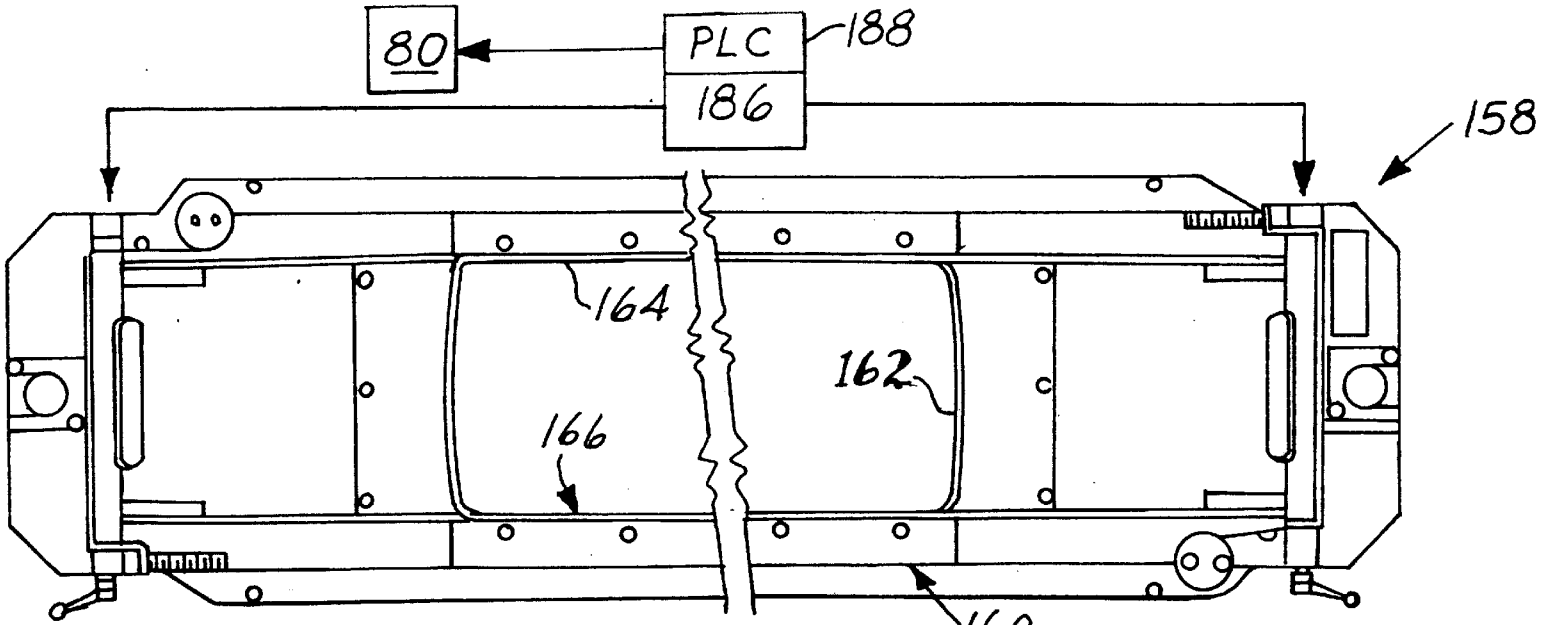
FIG. 29 is a plan view of a four-sided adjustable mold for making rolling ingot, opposing ends of which are reciprocable in relation to one another.
Figure 37:
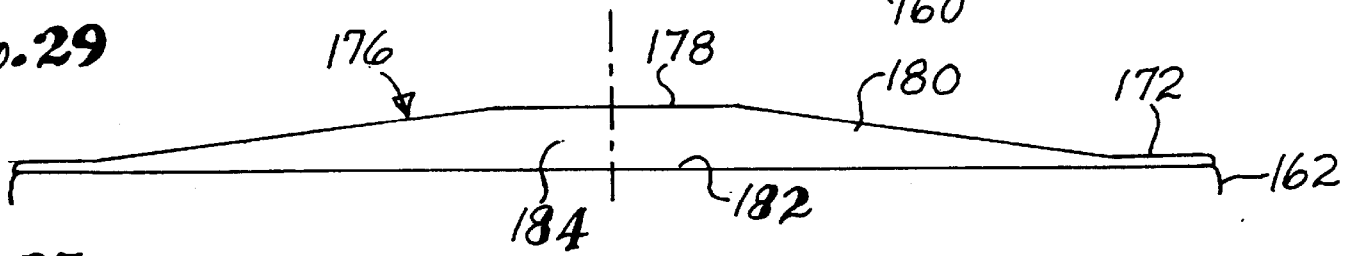
FIG. 37 is a schematic representation of the midsection of the adjustable mold when either of the sides shown in FIGS. 30 and 31 has been used to give the mold a particular length.
Figure 38:
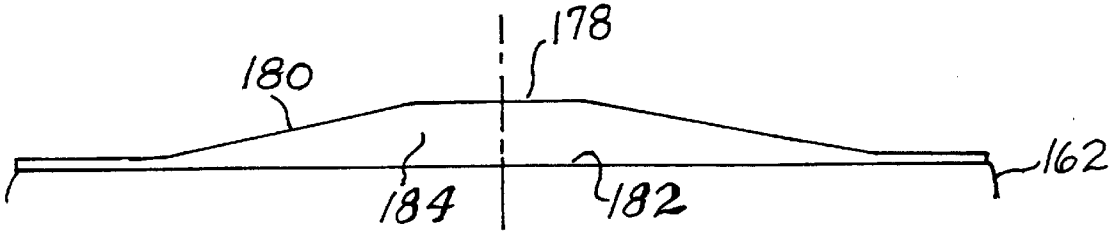
FIG. 38 is a second schematic representation of the midsection when the length of the mold has been reduced.

As indicated earlier, means have also been developed for controlling the size of the cross sectional area of the body of metal in the one second cross sectional plane 90 of the cavity in which "solidus" occurs. Referring initially to FIG. 28, it will be seen that this is accomplished very simply, if desired, by changing the speed of the casting operation so as to shift the first and second cross sectional planes of the cavity in relation to the surface of the ring, axially thereof. That is, by shifting the first and second cross sectional planes of the cavity to a wider band 156 of the surface, a larger circumferential outline is conferred on the cross sectional area of the body of metal; and conversely, by shifting the planes to a narrower band of the surface, a smaller circumferential outline is conferred on the area.

Figure 30:
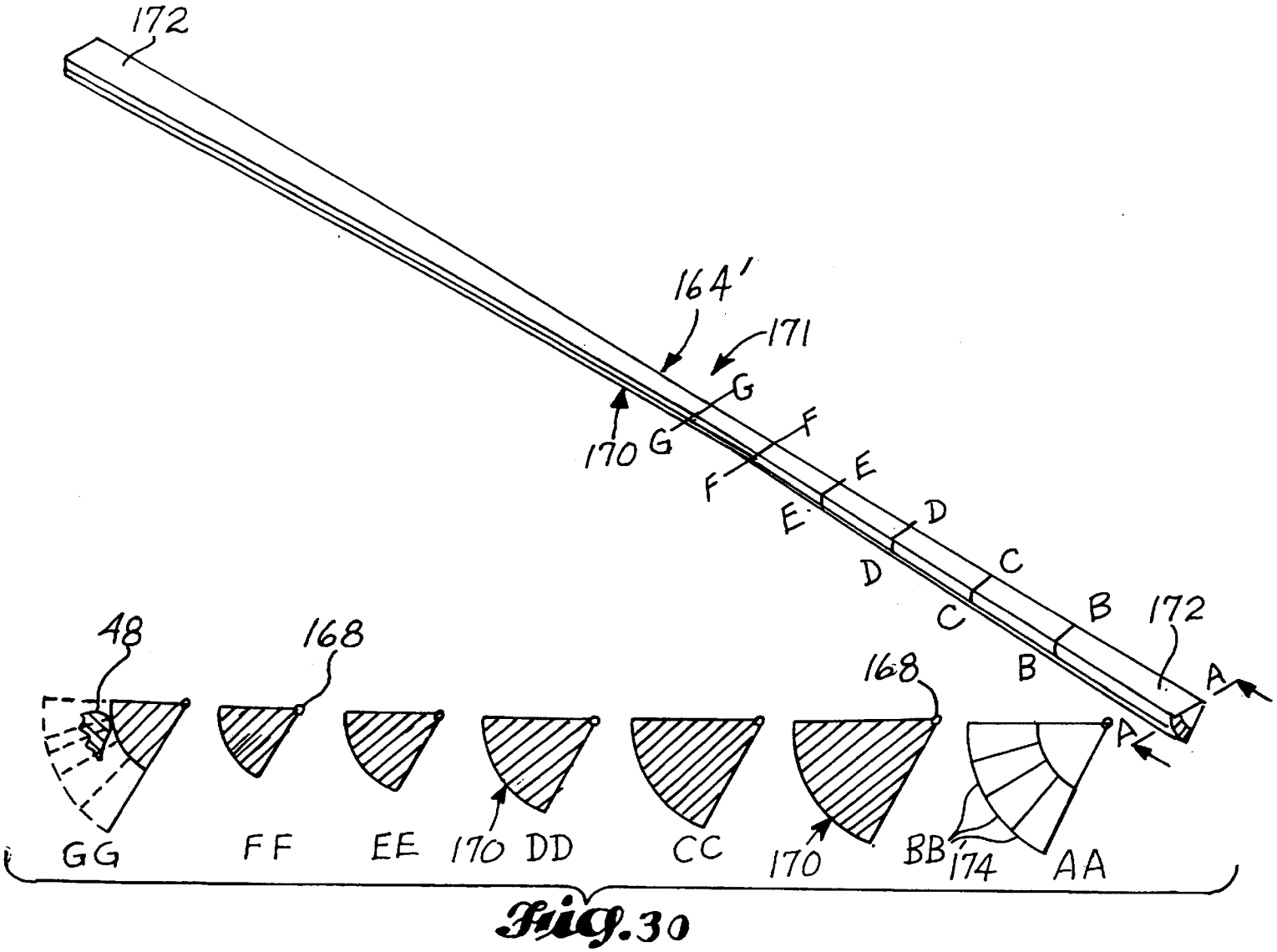
FIG. 30 is a part schematic representation of one of the pair of longitudinal sides of the mold when the longitudinal sides thereof are adapted to rotate in accordance with the invention.

Alternatively, the band 156 itself may be shifted, relative to the first and second cross sectional planes of the cavity, to achieve the same effect and in addition, to confer any circumferential outline desired on opposing sides of the body of metal, such as the flat-sided outline required for rolling ingot. In FIGS. 29–38, a way of doing this is shown in the context of an adjustable mold for casting rolling ingot. The mold 158 comprises a frame 160 adapted to support two sets of part annular casting members 162 and 164, which together form a rectangular casting ring 166 within the frame. The sets of members are cooperatively mitered at their corners so that one of the sets, 162, can be reciprocated in relation to one another, crosswise the axis of the cavity, to vary the length of the generally rectangular cavity defined by the ring 166. The other set of members, 164, is represented by either the member 164' in FIG. 30, or the member 164" in FIGS. 31–36. Referring first to FIG. 30, it will be seen that the member 164' is elongated, flat topped and rotatably mounted in the frame at 168. The member is also concavely recessed at the inside face 170 thereof, so that it is progressively reduced in cross section, crosswise the rotational axis 168 thereof, in the direction of the center portion 171 of the member from the respective ends 172 thereof See the respective cross sections of the member, AA through GG. Furthermore, the inside face 170 of the member is mitered at angularly successive intervals thereabout, and the respective mitered surfaces 174 of the face are tapered at progressively smaller radii of the fulcrum 168 in the direction of the bottom of the member from the top thereof Together then, the mitered effect and the reduced cross sectional effect produce a series of angularly successive lands 174 which extend along the inside face of the member, and curve or angle relatively reentrantly inwardly of the face to give the face a bulbous circumferential outline 176 which is characteristic of that needed for casting flat-sided rolling ingot. The outline is progressively greater in peripheral outward dimension from land to land about the contour of the face, however, so that the face will define corresponding but progressively peripherally outwardly greater cross sectional areas as the member 164' is rotated counterclockwise thereof. See the outline schematically represented at FIG. 37, and note that it has a center flat 178 and tapering intermediate sections 180 to either side thereof, which in turn flow into additional flats at the ends 172 of the member. When the ends 162 of the ring 166 (FIG. 29) are reciprocated in relation to one another to adjust the length of the cross sectional area of the cavity, the side members 164' are rotated in unison with one another until a pair of lands 174 is located on the members at which the compound longitudinal and crosswise taper thereof will preserve the circumferential outline of the cavity, side to side thereof, while at the same time also preserving the cross sectional dimension between the flats 178 of the members, so that the flatness in the sides 182 of the ingot will be preserved in turn.

Figures 31, 32, 33, 34, 35, 36:
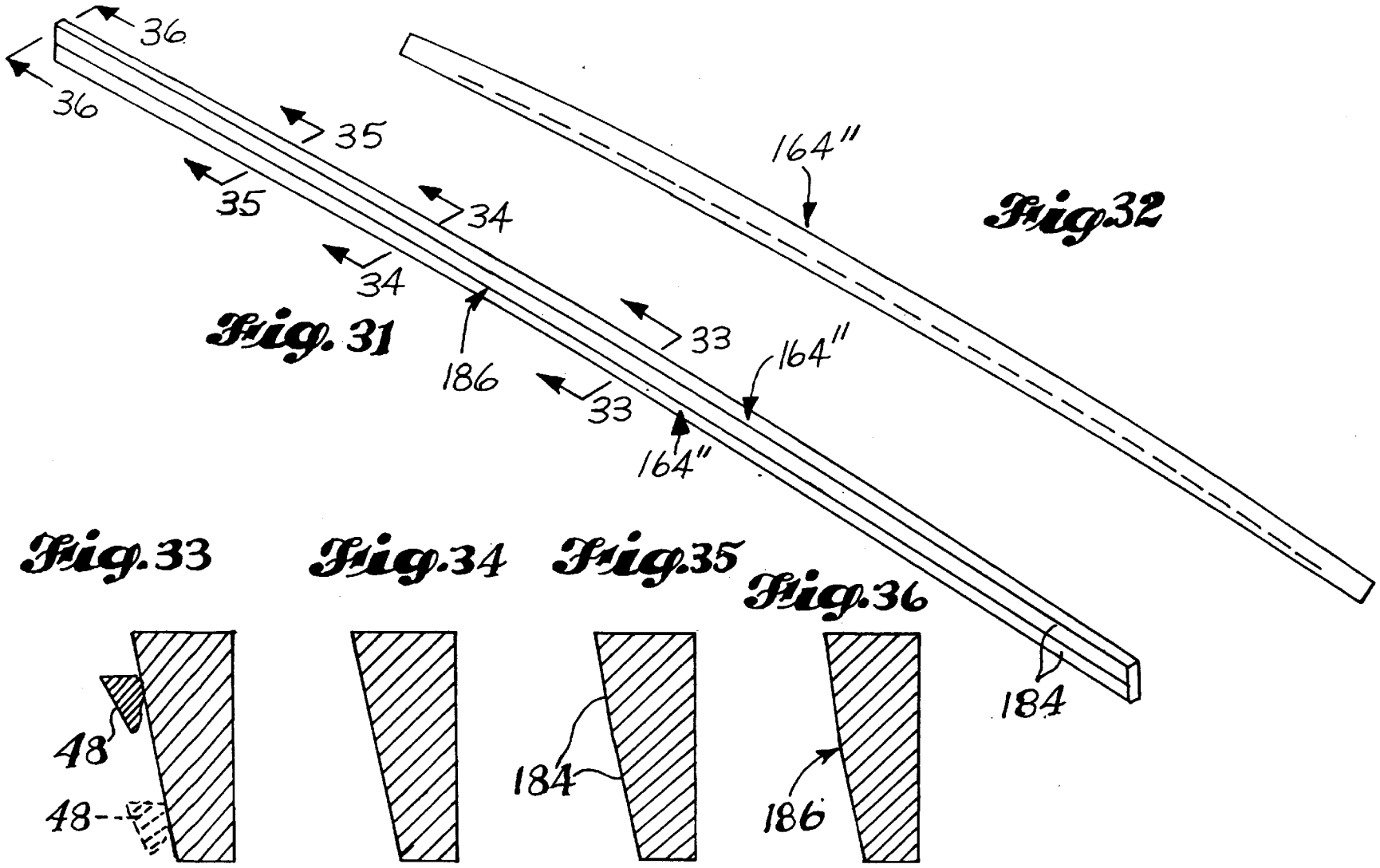
FIG. 31 is a perspective view of one of a pair of longitudinal sides of the adjustable mold when the sides thereof are fixed, rather than rotational.
FIG. 32 is a top plan view of the fixed side.
FIG. 33 is a cross section along the line 33—33 of FIG. 31.
FIG. 34 is a cross section along the line 34—34 of FIG. 31.
FIG. 35 is a cross section along the line 35—35 of FIG. 31.
FIG. 36 is a cross section along the line 36—36 of FIG. 31.

In FIGS. 31–36, the longitudinal sides 164" of the ring are fixed, but they are also convexly bowed longitudinally thereof, as seen in FIG. 32, and variably tapered at angularly successive intervals 184 about the inside faces 186 thereof, and once again, at tapers that also vary from cross section to cross section longitudinally of the members, to provide a compound topography, which like that of the faces 170 on the members 164' in FIG. 30, will preserve the bulbous contour 178 of the midsection 184 of the cavity, when the length of the same is adjusted by reciprocating the ends 162 of the ring in relation to one another. In this instance, however, because the side members 164" are fixed, the first and second cross sectional planes of the cavity are raised and lowered through an adjustment in the speed of the casting operation, so as to achieve a relative adjustment like that schematically shown at 48 in FIG. 33.

The ends 162 of the mold are mechanically or hydraulically driven at 186, but through an electronic controller 188 (PLC) which coordinates either the rotation of the rotors 164', or the level of the metal 48 between the members 164", to preserve the cross sectional dimensions of the cavity at the midsection 184 thereof when the length of the cavity is adjusted by the drive means 186.

Figure 23:
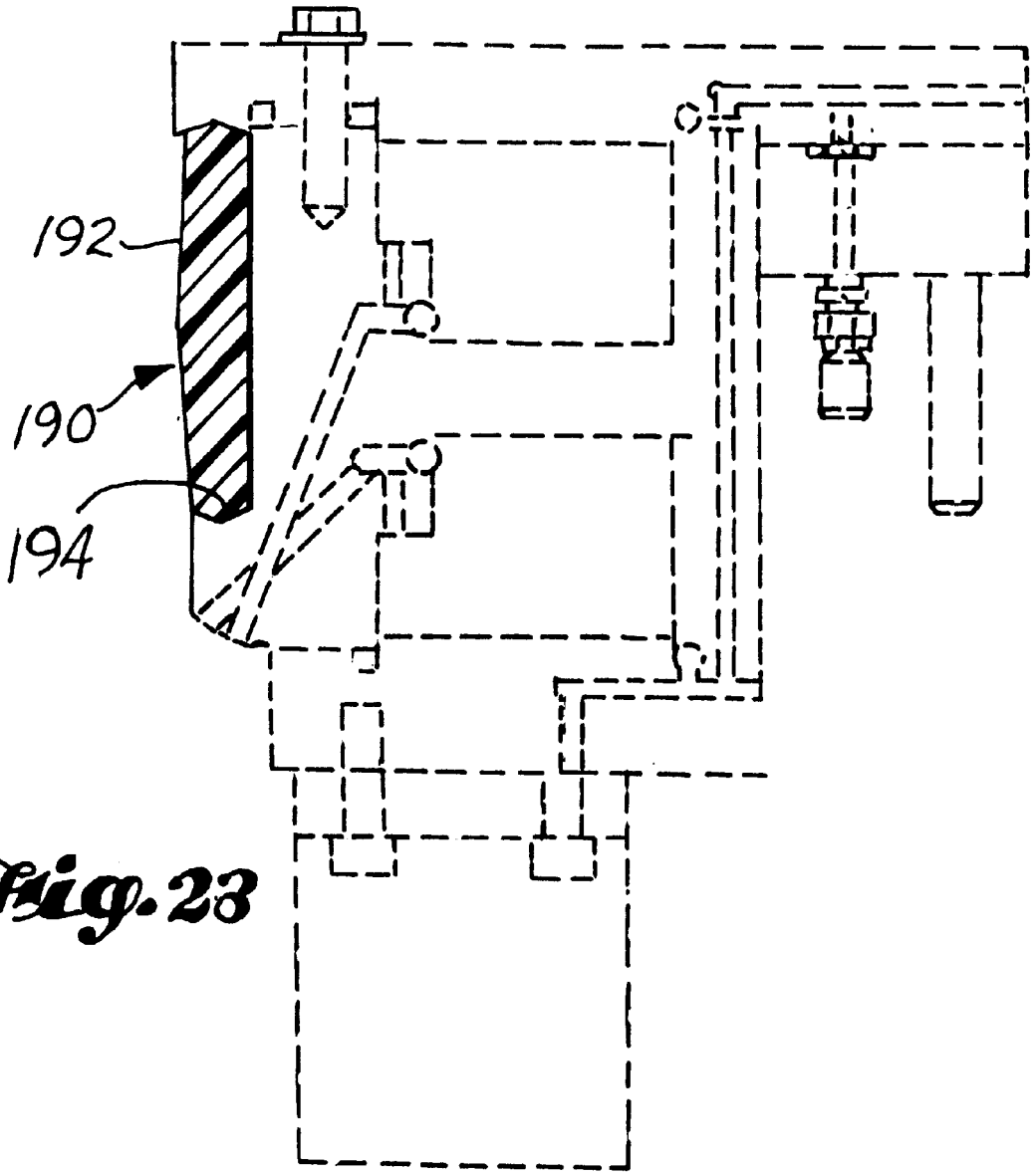
FIG. 23 is a largely phantomized cross section showing a reversible casting ring.

It is also possible to vary the cross sectional outline and/or cross sectional dimensions of the cross sectional area of the body of metal with a casting ring 190 (FIG. 23) which has oppositely disposed tapered sections 192 on the opposing sides thereof axially of the mold. Given differing tapers on the surfaces of the respective sections, the circumferential outline and/or the cross sectional dimensions of the cavity can be changed simply by inverting the ring. However, the ring 190 shown has the same taper on the surface of each section 192, and is employed only as a quick way of replacing one casting surface with another, say, when the first surface becomes worn or needs to be taken out of use for some other reason.

The ring 190 is shown in the context of a mold of the type disclosed in U.S. Pat. No. 5,323,841, and is mounted on a rabbet 194 and clamped thereto so that it can be removed, reversed, and reused as indicated. The other features shown in phantom can be found in U.S. Pat. No. 5,323,841.

The invention also assures that in ingot casting, the molten metal will fill the corners of the mold. As with the other parts of the mold, the corners may be elliptically rounded or otherwise shaped to enable the splaying forces to drive the metal into them most effectively. The invention is not limited, however, to shapes with rounded contours. Given suitable shaping of the second cross sectional areas, angles can be cast in what are otherwise rounded or unrounded bodies.

Figure 39:
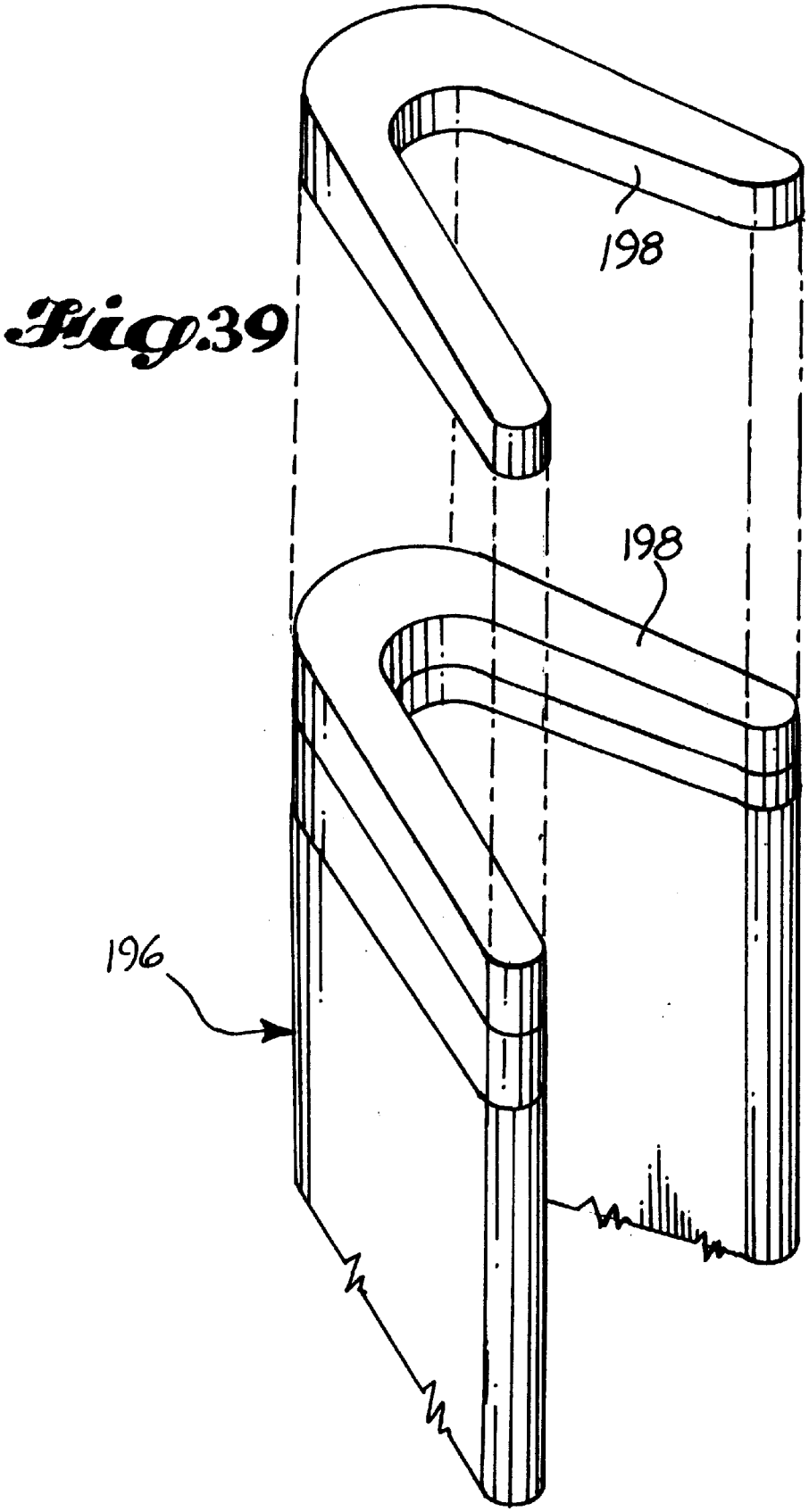
FIG. 39 is an exploded perspective view of an elongated end product of the invention that has been subdivided into a multiplicity of longitudinal sections thereof.
Figure 40:
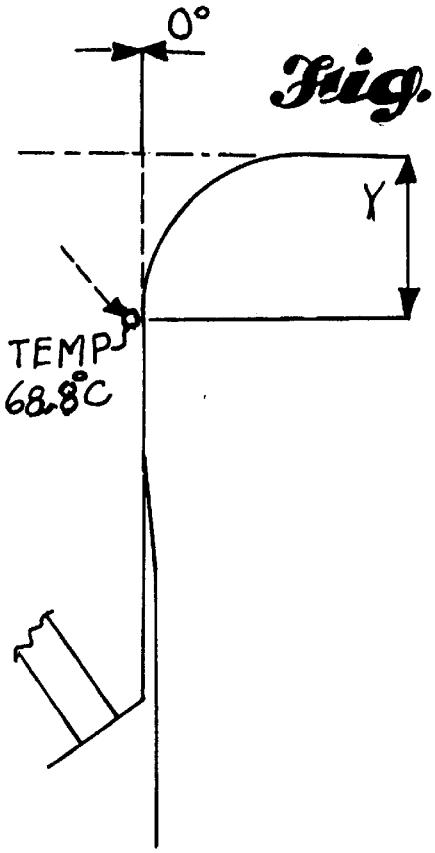
FIG. 40 is a schematic representation of a prior art mold that had been tested for the temperature thereof at the interface between the layers of molten metal and the casting surface.
Figure 41:
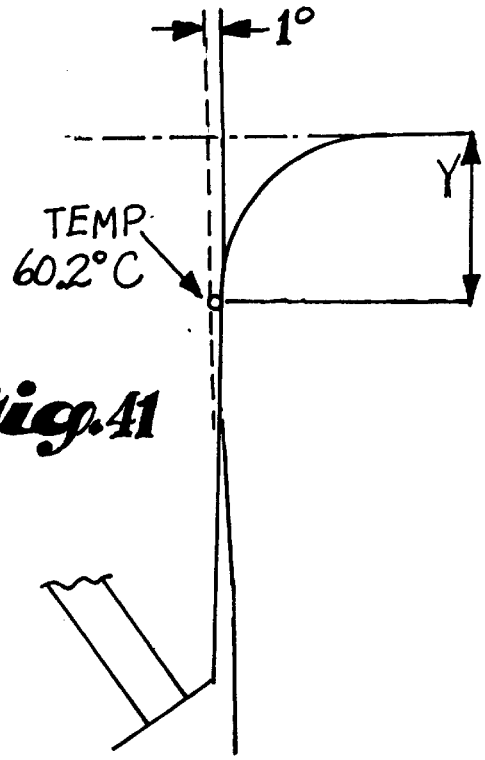
FIG. 41 is a similar representation of one of the inventive casting molds that had been tested for the temperature at its interface when a one degree taper was used in the casting surface.
Figure 42:
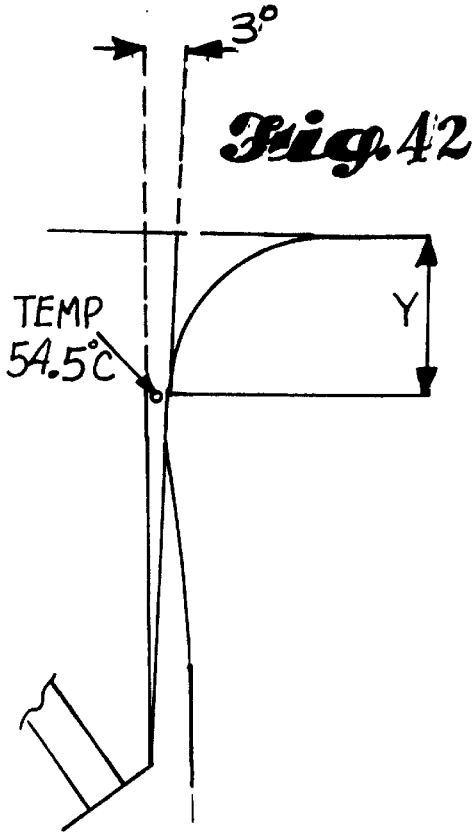
FIG. 42 is a representation similar to FIG. 41 when a three degree taper was used in the casting surface.
Figure 43:
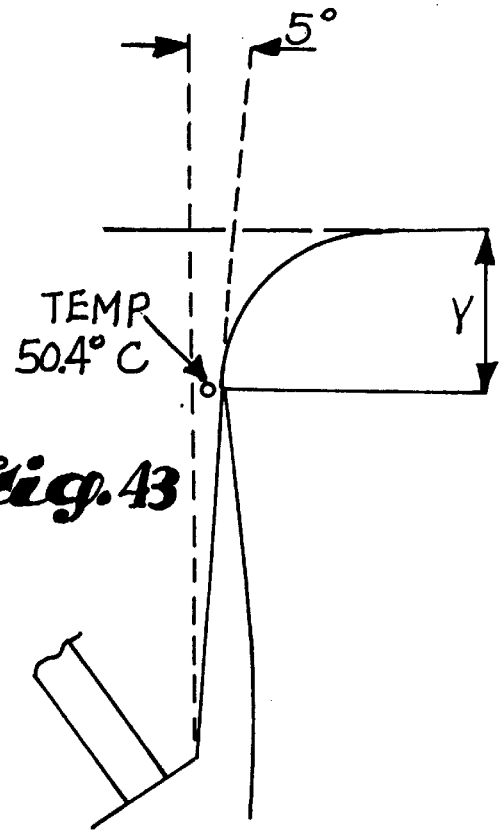
FIG. 43 is another such representation when a five degree taper was used in the casting surface.

The cast product 196 may be sufficiently elongated to be subdividable into a multiplicity of longitudinal sections 198, as is illustrated in FIG. 39 wherein the V-shaped piece 196 molded in a cavity like that of FIGS. 9–15 and 17, is shown as having been so subdivided. If desired, moreover, each section may be post-treated in some manner, such as given a light forging or other post-treatment in a plastic state to render it more suitable as a finished product, such as a component of an automobile carriage or frame.

Where other than molten startup material is used, the body of startup material 70 should be formulated to function as a "moving floor" or "bulkhead" for the accumulating layers of molten metal.

FIGS. 39–42 are included to show the dramatic decrease in the temperature of the interface between the casting surface and the molten metal layers when the present means and technique are employed in casting a product. They also show that the decrease is a function of the degree of taper used at any particular point about the interface, circumferentially of the mold. In fact, the best degree of taper from point to point is often determined from taking successive thermocouple readings about the circumference of the mold.

Like the splaying forces, the thermal contraction forces are a function of many factors, including the metal being cast.

What is claimed is:

1. In combination, an apparatus defining an open ended mold cavity having an entry end portion, a discharge end opening, and an axis extending between the discharge end opening and the entry end portion of the cavity, and wherein molten metal is cast into a form-sustaining body of metal by forcing the molten metal into the entry end portion of the cavity while a starter block telescopically engaged in the discharge end opening of the cavity is reciprocated relatively outwardly from the cavity along the axis thereof, a body of startup material interposed between the starter block and a first cross sectional plane of the cavity extending relatively transverse the axis thereof is reciprocated in tandem with the starter block through a series of second cross sectional planes of the cavity extending relatively transverse the axis thereof, and successive layers of molten metal are relatively superimposed on the body of startup material adjacent the first cross sectional plane of the cavity so as to have inherent splaying forces therein acting to distend the layers relatively peripherally outwardly from the axis of the cavity adjacent the first cross sectional plane thereof, means for confining the relatively peripheral outward distention of respective layers of the molten metal to a first cross sectional area of the cavity in the first cross sectional plane thereof, while permitting the respective layers to distend relatively peripherally outwardly from the circumferential outline of the first cross sectional area at relatively peripherally outwardly inclined angles to the axis of the cavity in which the layers assume progressively relatively peripherally outwardly greater second cross sectional areas of the cavity in second cross sectional planes thereof, means for generating thermal contraction forces in the respective layers as the layers assume the second cross sectional areas, and means for controlling the magnitude of the thermal contraction forces in the respective layers so that the thermal contraction forces counterbalance the splaying forces in the respective layers at one of the second cross sectional planes of the cavity and thereby confer a free-formed circumferential outline on the body of metal as the body of metal becomes form-sustaining.

2. The combination according to claim 1 further comprising means for circumposing a sleeve of pressurized gas about the layers of molten metal in the second cross sectional planes of the cavity.

3. The combination according to claim 1 further comprising means for circumposing an annulus of oil about the layers of molten metal in the second cross sectional planes of the cavity.

4. The combination according to claim 1 further comprising means for generating a reentrant baffling effect in cross sectional planes of the cavity extending transverse the axis thereof between the one second cross sectional plane of the cavity and the discharge end opening thereof to induce "rebleed" to reenter the body of metal.

5. The combination according to claim 1 wherein the axis of the cavity is oriented along a vertical line, the distention confining means are operable to confine the first cross sectional area to a circular circumferential outline, and the combination further comprises means for conferring a non-circular circumferential outline on the body of metal at the one second cross sectional plane of the cavity.

6. The combination according to claim 1 wherein the axis of the cavity is oriented along an angle to a vertical line, the distention confining means are operable to confine the first cross sectional area to a circular circumferential outline, and the combination further comprises means for conferring a circular circumferential outline on the body of metal at the one second cross sectional plane of the cavity.

7. The combination according to claim 1 wherein the axis of the cavity is oriented along one of a vertical line and an angle to a vertical line, the distention confining means are operable to confine the first cross sectional area to a non-circular circumferential outline, and the combination further comprises means for conferring a non-circular circumferential outline on the body of metal at the one second cross sectional plane of the cavity.

8. The combination according to claim 1 wherein the means for generating thermal contraction forces are operable to generate the thermal contraction forces in all of the angularly successive part annular portions of the layers arrayed about the circumferences of the layers.

9. The combination according to claim 1 further comprising lubricating means for circumposing an oil encompassed sleeve of pressurized gas about the layers of molten metal in the second cross sectional planes of the cavity.

10. The combination according to claim 9 wherein the lubricating means are operable to discharge the pressurized gas and oil into the cavity at the second cross sectional planes thereof.

11. The combination according to claim 1 further comprising means operable in conjunction with the orientation of the axis of the cavity to a vertical line and the circumferential outline to which the first cross sectional area is confined, to vary at least one control parameter in the group consisting of the relative thermal contraction forces generated in the respective angularly successive part annular portions of the layers arrayed about the circumferences thereof in the second cross sectional planes of the cavity and the relative angles at which the respective part annular portions of the layers are permitted to distend from the circumferential outline of the first cross sectional area into the series of second cross sectional planes to assume the second cross sectional areas thereof, to generate a desired shape in the circumferential outline conferred on the body of metal in the one second cross sectional plane of the cavity.

12. The combination according to claim 11 wherein the means for varying the one control parameter are operable to neutralize variances between the differentials existing between the respective splaying and thermal contraction forces in angularly successive part annular portions of the layers that are mutually opposed to one another across the cavity in third cross sectional planes of the cavity extending parallel to the axis thereof.

13. The combination according to claim 11 wherein the means for varying the one control parameter are operable to create variances between the differentials existing between the respective splaying and thermal contraction forces in angularly successive part annular portions of the layers that are mutually opposed to one another across the cavity in third cross sectional planes of the cavity extending parallel to the axis thereof.

14. The combination according to claim 1 further comprising means for equalizing the thermal contraction forces generated in those angularly successive part annular portions of the layers arrayed about the circumferences thereof and disposed on mutually opposing sides of the cavity, to balance the thermal stresses arising between the respective mutually opposing part annular portions of the layers at the one second cross sectional plane of the cavity.

15. The combination according to claim 14 wherein the means for generating thermal contraction forces include means for extracting heat from the angularly successive part annular portions of the layers in second cross sectional planes of the cavity, and the means for balancing the thermal stresses generated in part annular portions of the layers disposed on mutually opposing sides of the cavity include means for varying the rate of heat extraction between the respective mutually opposing part annular portions of the layers.

16. The combination according to claim 15 wherein the heat extraction means include means for discharging liquid coolant onto the body of metal at the opposite side of the one second cross sectional plane of the cavity from the first cross sectional plane thereof, and the means for varying the rate of heat extraction from the mutually opposing part annular portions of the layers include means for varying the volume of liquid coolant discharged onto the respective angularly successive part annular portions of the body of metal.

17. The combination according to claim 1 wherein the means for generating thermal contraction forces include means for extracting heat from the respective layers in the direction relatively peripherally outwardly from the axis of the cavity in second cross sectional planes thereof.

18. The combination according to claim 17 wherein the heat extraction means include a heat conductive medium operatively arranged about the circumferential outlines of the second cross sectional areas of the cavity, and means for extracting heat from the layers through the medium.

19. The combination according to claim 18 further comprising heat conductive baffling means arranged about the circumferential outlines of the second cross sectional areas of the cavity, and wherein the heat extraction means include means for extracting heat from the layers through the baffling means.

20. The combination according to claim 19 wherein the means for extracting heat from the layers through the baffling means include an annular chamber circumposed about the baffling means and means for circulating liquid coolant through the chamber.

21. The combination according to claim 17 further comprising means for extracting heat from the layers through the body of metal.

22. The combination according to claim 21 wherein the means for extracting heat from the layers through the body of metal include means for discharging liquid coolant onto the body of metal at the opposite side of the one second cross sectional plane of the cavity from the first cross sectional plane thereof.

23. The combination according to claim 22 wherein the liquid coolant discharge means are operable to discharge the liquid coolant onto the body of metal between planes extending transverse the axis of the cavity and coinciding with the bottom and rim of the trough-shaped model formed by the successively convergent isotherms of the body of metal.

24. The combination according to claim 22 further comprising means defining an annulus circumposed about the axis of the cavity between the one second cross sectional plane of the cavity and the discharge end opening thereof, and wherein the liquid coolant discharge means are operable to discharge the liquid coolant onto the body of metal from the annulus.

25. The combination according to claim 22 further comprising means defining an annulus circumposed about the axis of the cavity on the other side of the discharge end opening of the cavity from the one second cross sectional plane thereof, and wherein the liquid coolant discharge means are operable to discharge the liquid coolant onto the body of metal from the annulus.

26. The combination according to claim 22 further comprising means defining a series of holes arranged in an annulus about the axis of the cavity and divided into rows of holes in which the respective holes thereof are staggered in relation to one another from row to row, and wherein the liquid coolant discharge means are operable to discharge the liquid coolant from the series of holes.

27. The combination according to claim 26 wherein the annulus is circumpositioned on the mold at the inner periphery of the cavity.

28. The combination according to claim 26 wherein the annulus is circumpositioned on the mold relatively outside of the cavity adjacent the discharge end opening thereof.

29. The combination according to claim 1 further comprising baffling means arranged about the axis of the cavity to confine the relatively peripheral outward distention of the respective layers to the respective first and second cross sectional areas thereof.

30. The combination according to claim 29 wherein the baffling means define a series of annular surfaces that are circumposed about the axis of the cavity to confine the relatively peripheral outward distention of the layers to the first cross sectional area of the cavity while permitting respective layers to assume progressively peripherally outwardly greater second cross sectional areas of the cavity in second cross sectional planes thereof.

31. The combination according to claim 30 wherein the individual annular surfaces are arranged in axial succession to one another, but staggered relatively peripherally outwardly to one another in the respective first and second cross sectional planes of the cavity, and are oriented along relatively peripherally outwardly inclined angles to the axis of the cavity so as to permit the respective layers to assume progressively peripherally outwardly greater second cross sectional areas in second cross sectional planes of the cavity.

32. The combination according to claim 30 wherein the annular surfaces are interconnected with one another axially of the cavity to form an annular skirt.

33. The combination according to claim 32 wherein the skirt has a rectilinear flare about the inner periphery thereof.

34. The combination according to claim 32 wherein the skirt has a curvilinear flare about the inner periphery thereof.

35. The combination according to claim 32 wherein the skirt is formed on the wall of the cavity at the inner periphery thereof between the first cross sectional plane of the cavity and the discharge end opening thereof.

36. The combination according to claim 35 wherein a graphite casting ring forms a portion of the wall, and the skirt is formed on the ring about the inner periphery thereof.

37. The combination according to claim 1 further comprising size variation means for confining the first cross sectional area of the cavity to a first size for a first casting operation, and then confining the first cross sectional area of the cavity to a second and different size for a second casting operation in the cavity, so that the size of the cross sectional area conferred on the body of metal at the one second cross sectional plane of the cavity is varied from the first to the second casting operation.

38. The combination according to claim 37 wherein the size variation means include means for changing the circumferential extent of the circumferential outline to which the first cross sectional area is confined in the first cross sectional plane of the cavity.

39. The combination according to claim 38 further comprising baffling means arranged about the axis of the cavity to confine the distention of the layers to the first and second cross sectional areas of the cavity, and wherein the baffling means are divided into a pair thereof arranged about the axis of the cavity in axial succession to one another, and the means for changing the circumferential extent of the circumferential outline to which the first cross sectional area is confined, include means for shifting the pair of baffling means in relation to one another axially of the cavity.

40. The combination according to claim 39 wherein the pair of baffling means is adapted to be inverted in relation to one another axially of the cavity.

41. The combination according to claim 38 further comprising baffling means arranged about the axis of the cavity and adapted to confine the distention of the layers to the respective first and second cross sectional areas of the cavity, and wherein the baffling means are divided into pairs thereof arranged about the axis of the cavity on pairs of mutually opposing sides thereof, and the means for changing the circumferential extent of the circumferential outline to which the first cross sectional area is confined in the first cross sectional plane of the cavity, include means for shifting the respective pairs of baffling means in relation to one another crosswise the axis of the cavity.

42. The combination according to claim 41 wherein one of the pairs of baffling means is mounted to be reciprocated relatively crosswise the axis of the cavity and the means for shifting the respective pairs of baffling means in relation to one another include means operable to reciprocate the one pair of baffling means relatively crosswise the axis of the cavity.

43. The combination according to claim 42 wherein another of the pairs of baffling means is rotatably mounted about axes of rotation transverse the axis of the cavity and the means for shifting the respective pairs of baffling means in relation to one another also include means operable to rotate the other pair of baffling means about the axes of rotation thereof.

44. The combination according to claim 38 further comprising baffling means arranged about the axis of the cavity and adapted to confine the distention of the layers to the respective first and second cross sectional areas of the cavity, and wherein the means for changing the circumferential extent of the circumferential outline to which the first cross sectional area of the cavity is confined, include means for shifting the baffling means and the first and second cross sectional planes of the cavity in relation to one another.

45. The combination according to claim 44 wherein the means for shifting the baffling means and the first and second cross sectional planes of the cavity in relation to one another include means for varying the volume of molten metal that is superimposed on the body of startup material so as to shift the respective planes in relation to the baffling means.

46. The combination according to claim 44 wherein the baffling means are rotatably mounted about an axis of rotation transverse the axis of the cavity and the means for shifting the baffling means and the first and second cross sectional planes of the cavity in relation to one another include means for rotating the baffling means about the axis of rotation thereof.

* * * * *